US005526025A

United States Patent [19]

Selwan et al.

[11] Patent Number: 5,526,025

[45] Date of Patent: Jun. 11, 1996

[54] METHOD AND APPARATUS FOR PERFORMING RUN LENGTH TAGGING FOR INCREASED BANDWIDTH IN DYNAMIC DATA REPETITIVE MEMORY SYSTEMS

[75] Inventors: Pierre M. Selwan, Fremont; David G. Reed; Arun Johary, both of San Jose; Morris E. Jones, Jr., Saratoga; Edward P. Hutchins, Cupertino; Mahesh Siddappa, San Jose, all of Calif.

[73] Assignee: Chips and Technolgies, Inc., San Jose, Calif.

[21] Appl. No.: 49,480

[22] Filed: Apr. 19, 1993

Related U.S. Application Data

[63] Continuation-in-part of Ser. No. 864,979, Apr. 7, 1992, abandoned.

[51] Int. Cl.[6] ..... G09G 5/00

[52] U.S. Cl. ..... 345/200; 345/201; 345/185

[58] Field of Search ..... 345/185, 189, 345/190, 192, 193, 200, 201, 203, 148

[56] References Cited

U.S. PATENT DOCUMENTS

| | | | |
|---|---|---|---|
| 3,646,520 | 2/1972 | Spencer | 340/172.5 |
| 4,037,203 | 7/1977 | Stalley | 364/900 |
| 4,049,953 | 9/1977 | Evans, Jr. | 253/150.3 |
| 4,214,269 | 7/1980 | Parker et al. | 358/140 |
| 4,233,601 | 11/1980 | Hankins et al. | 345/202 |
| 4,292,667 | 9/1981 | Catiller et al. | 364/200 |
| 4,394,641 | 7/1983 | Ratigalas | 340/347 DD |
| 4,412,306 | 10/1983 | Moll | 364/900 |
| 4,414,629 | 11/1983 | Waite | 364/300 |
| 4,435,831 | 3/1984 | Mozer | 381/30 |
| 4,488,254 | 12/1984 | Ward | 345/200 |
| 4,491,934 | 1/1985 | Heinz | 364/900 |
| 4,500,871 | 2/1985 | Ratigalas | 340/347 DD |
| 4,586,027 | 4/1986 | Tsukiyama et al. | 340/347 DD |
| 4,677,626 | 6/1987 | Betts et al. | 371/43 |
| 4,816,815 | 3/1989 | Yoshiba | 345/201 |
| 4,864,290 | 9/1989 | Waters | 345/148 |
| 4,890,100 | 12/1989 | Kurakake | 345/189 |
| 4,954,951 | 9/1990 | Hyatt | 395/421.8 |
| 4,958,304 | 9/1990 | Moore | 345/201 |
| 4,970,501 | 11/1990 | Trambale | 340/750 |
| 5,003,471 | 3/1991 | Gibson | 364/200 |
| 5,111,194 | 5/1992 | Oneda | 345/185 |
| 5,122,789 | 6/1992 | Ito | 340/731 |
| 5,136,702 | 8/1992 | Shibata | 395/425 |
| 5,212,742 | 5/1993 | Normile et al. | 282/56 |

OTHER PUBLICATIONS

Mano, Computer system architecture, 1982, 2nd edition, pp. 479–521.

*Primary Examiner*—Richard Hjerpe
*Assistant Examiner*—Kent Chang
*Attorney, Agent, or Firm*—Flehr, Hohbach, Test, Albritton & Herbert

[57] ABSTRACT

A method and apparatus for improving bandwidth of sequential access to a display data memory. Display data and tag information related to consecutive data repetitions are stored. No display memory access is needed to output data to the CRT during the time periods when data is being repeated, thus increasing display memory bandwidth. Display data from a location in display memory is stored in a latch, and is output from the latch until the tag information indicates no more data repetitions occur.

24 Claims, 18 Drawing Sheets

| 616 | DISPLAY DATA 32-BIT (618) | RUN LENGTH TAG 4-BIT (620) |
|---|---|---|
| 00 0 | 0A | 4 |
| 00 1 | 0A | X |
| 00 2 | 0A | X |
| 00 3 | 0A | X |
| 00 4 | 0A | X |
| 00 5 | 12 | 3 |
| 00 6 | 12 | X |
| 00 7 | 12 | X |
| 00 8 | 12 | X |
| 00 9 | 3C | 0 |
| 00 A | 5B | 0 |
| 00 B | 3C | 0 |
| 00 C | 5B | 2 |
| 00 D | 5B | X |
| 00 E | 5B | X |
| 00 F | 5B | DON'T CARE (614) |
| 01 0 | 5B | 1 |
| 01 1 | 5B | X |
| 01 2 | 0A | 2 |
| 01 3 | 0A | X |
| 01 4 | 0A | X |
| 01 5 | 12 | 7 |
| 01 6 | 12 | X |
| 01 7 | 12 | X |
| 01 8 | 12 | X |
| 01 9 | 12 | X |
| 01 A | 12 | X |
| 01 B | 12 | X |
| 01 C | 12 | X |
| 01 D | 5B | 1 |
| 01 E | 5B | X |
| 01 F | 5B | DON'T CARE (614) |
| 01 0 | 0A | E |
| 01 1 | 0A | X |

| | | DISPLAY DATA 32-BIT | RUN LENGTH TAG 4-BIT |
|---|---|---|---|
| 00 | 0 | 0A | 5 |
| 00 | 1 | 0A | X |
| 00 | 2 | 0A | X |
| 00 | 3 | 0A | X |
| 00 | 4 | 0A | X |
| 00 | 5 | 12 | 9 |
| 00 | 6 | 12 | X |
| 00 | 7 | 12 | X |
| 00 | 8 | 12 | X |
| 00 | 9 | 3C | A |
| 00 | A | 5B | B |
| 00 | B | 3C | C |
| 00 | C | 5B | F |
| 00 | D | 5B | X |
| 00 | E | 5B | X |
| 00 | F | 5B | DON'T CARE |
| 01 | 0 | 5B | 2 |
| 01 | 1 | 5B | X |
| 01 | 2 | 0A | 5 |
| 01 | 3 | 0A | X |
| 01 | 4 | 0A | X |
| 01 | 5 | 12 | D |
| 01 | 6 | 12 | X |
| 01 | 7 | 12 | X |
| 01 | 8 | 12 | X |
| 01 | 9 | 12 | X |
| 01 | A | 12 | X |
| 01 | B | 12 | X |
| 01 | C | 12 | X |
| 01 | D | 5B | F |
| 01 | E | 5B | X |
| 01 | F | 5B | DON'T CARE |
| 01 | 0 | 0A | F |
| 01 | 1 | 0A | X |
614
614
FIG. 6E
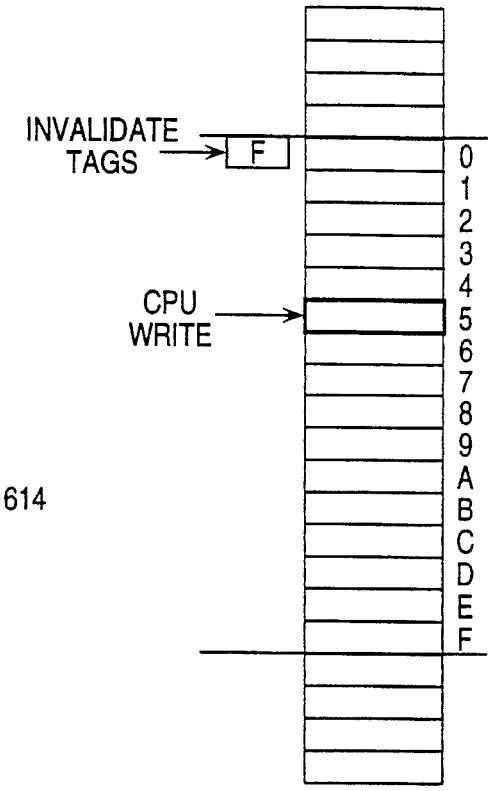
FIG. 7
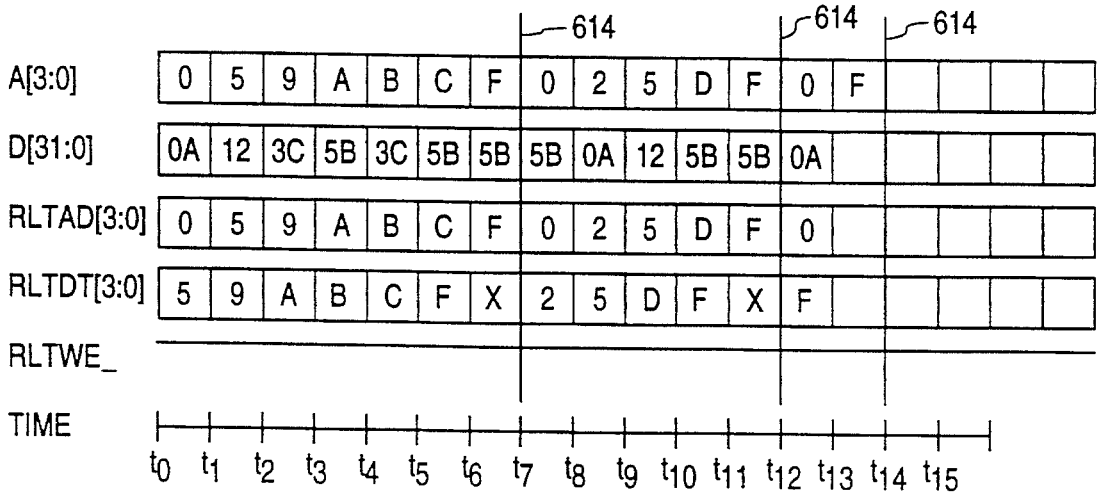
FIG. 6F

| ADDRESS | CONTENT |
|---|---|
| | • • • |
| X | TAG FOR DWORDS Y THROUGH (Y+31) |
| X+1 | DWORD Y |
| X+2 | DWORD Y+1 |
| • • • | • • • |
| X+31 | DWORD Y+30 |
| X+32 | DWORD Y+31 |
| X+33 | TAG FOR DWORDS (Y+32) THROUGH (Y+63) |
| X+34 | DWORD Y+32 |
| • • • | • • • |

METHOD AND APPARATUS FOR PERFORMING RUN LENGTH TAGGING FOR INCREASED BANDWIDTH IN DYNAMIC DATA REPETITIVE MEMORY SYSTEMS

CROSS REFERENCE TO RELATED APPLICATION

This application is a continuation-in-part of application Ser. No. 07/864,979, filed Apr. 7, 1992, now abandoned, the disclosure of which is hereby incorporated by reference.

BACKGROUND OF THE INVENTION

The present invention relates generally to computer graphics, and more specifically to improvements in a display controller architecture which improves readback bandwidth of sequential access to display data memory.

The last several years have seen an evolution in the IBM-compatible personal computer field as the once heralded original PC has given way to models referred to as the XT and the AT, and current models based on Intel's 80386 and 80486 microprocessors. Software developed for use with systems now available increases the demand on display controllers. Consumer demand for increased resolution, an improved color palette, and faster raster scans to improve the ergonomics of the graphic user interface has added to the pressure on display control systems.

FIG. 1 shows a prior art computer system 100 which is capable of video graphic display. The computer system comprises a CPU 110, a system memory 112, and a display system 102. The display system comprises a display controller 116, a display memory 124, and a display device such as a CRT monitor (or CRT) 120. Clearly, references to a CRT should be taken to include other display devices such as LCD flat panel displays and the like. CPU 110 generates data to be drawn into a particular pixel location on CRT 120 of display system 102. This can be done by transferring actual pixel data or by transferring instructions to special drawing circuitry in the display controller.

Display memory 124 can be viewed as a single memory. Given current technology at the time the parent to this application was filed, the memory is typically implemented as a plurality of memory chips. For example, a 1-MByte memory is often implemented using two 256K×16 (bit) memory chips. Whether the memory is implemented as a single chip or a plurality of chips, it is often referred to as a memory array.

Data to be drawn is stored in display memory 124 until it is sequentially accessed by display controller 116 for output onto the CRT. Upon CPU initialization, data is transferred from system memory 112 to display controller 116 along a data bus 114, and from display controller 116 to display memory 124 along a display memory data bus 122. Data displayed on the CRT is transferred from display memory 124 to the display controller 116 along display memory data bus 122, and from display controller 116 to CRT 120 on a CRT bus 118. Thus, data paths from CPU 110 (or portions of the display controller) to display memory 124 and from display memory 124 to the CRT 120 both transfer data on display memory bus 122. The display controller arbitrates between the two types of data transfers (CPU 110 to display memory 124, and display memory 124 to CRT 120). The screen refresh (reads from display memory) must take precedence over updating display memory (writes to display memory) since the screen must be refreshed at fixed intervals.

The evolution of video display systems towards increased resolution, improved color palette, and faster raster display increases the demand on the system. Increasing the number of colors available on the screen increases the number of bits per pixel. Increased system resolution increases the amount of data transferred since the number of pixels per screen is increased. For example, for resolutions of 1024×768 pixels with 8 bits per pixel, the display memory is over 5 times the size as for the standard 640×480 pixels with 4 bits per pixel. Thus, over 5 times the amount of data is transferred to the CRT.

As the resolution increases, the number of data transfers from CPU 110 to display memory 124 (on buses 114 and 122) and from display memory 124 to CRT 120 (on buses 122 and 118) increases. In addition, as the display refresh rate increases data transfers from display memory 124 to the CRT 120 increase. This increases the number of accesses on both the display memory bus 122 and CRT bus 118.

The bandwidth of display memory 124 (number of data accesses per second) is limited by the physical characteristics of the display memory. The number of data accesses to display memory 124 is typically in the range of 100 Mbytes per second. As noted above, refreshing the CRT has priority over CPU 110 to display memory 124 transfers. Thus, accesses from display memory 124 to the CRT 120 decrease the amount of time available to CPU 110 for access to the display memory 124 for CPU to display memory transfers. With increased resolution, color depth and refresh rates, the CPU must wait longer for access to display memory 124 on display memory bus 122.

FIG. 2 is a graphical representation illustrating the decreased CPU access available as the resolution increases. The x-axis indicates the resolution given a constant refresh rate and color depth; the y-axis indicates the bandwidth in bytes per second. Line 210 indicates the constant maximum bandwidth of display memory. Line 212 shows the amount of access time required for display memory to CRT transfers at a given resolution. The distance 214 under curve 212 is the bandwidth used for display memory to CRT transfers at a particular resolution. The distance 216 is the bandwidth available for CPU to display memory data transfers.

From FIG. 2, it can clearly be seen that as the resolution of the display increases, the amount of time available for the CPU decreases. Since priority must be given to refreshing the display, there is a delay in updating the display memory. From the user's point of view, the supposedly fast computer is sluggish and unresponsive.

One method of avoiding problems of contention between the CPU and the CRT for control of the display memory bus is to use a VRAM (Video RAM). FIG. 3 is a block diagram of a prior art display system 300 using a VRAM 310 to store display data. The display system comprises a VRAM 310, a display controller 316, a CRT monitor 320, a CPU 322 and a system memory 324.

Unlike the conventional DRAM 124 shown in the system illustrated in FIG. 1, VRAM 310 has two paths between display controller 316 and display memory 310. The first data path is a bidirectional bus 312 used solely for CPU 322 to display memory 310 data transfers. The second path is a unidirectional serial data bus 314 used only for display memory 310 to CRT 320 transfers. The serial port of VRAM 310 exploits the nature of the video display system 300 since data transferred from display memory 310 to the CRT 320 is transferred to the CRT 320 from contiguous memory locations. Although by providing dual data buses the VRAM avoids the problem of data contention with almost no overhead to the bandwidth, a VRAM is much more expensive than a conventional DRAM. An inexpensive display system for increasing bandwidth allocation on a display memory bus is needed.

SUMMARY OF THE INVENTION

The present invention provides a method and apparatus for reducing the number of accesses to a display memory while fully refreshing the display, all without the need to use expensive VRAM. The invention thus provides additional bandwidth for updating the display memory so that changes to the display data appear on the display with less delay. The reduced number of memory accesses also reduces power consumption, a key advantage for laptop computers.

In short, the present invention recognizes and takes advantage of the fact that data is transferred from the display memory according to a fixed sequence (normally from consecutive data memory locations) and that the data being displayed is typically very repetitive. The present invention exploits this recognition by keeping track of data repetitions, and only accessing the display memory when a data item to be sent to the display is not known to be the same as the previous data item.

Thus, the invention operates to reduce the number of memory accesses in the course of providing a predetermined sequence of data items stored in a display memory (typically, but not necessarily, at adjacent locations). It accomplishes this by maintaining a record of data repetitions, if any, in the predetermined sequence of data items, accessing the memory to retrieve a subset of the predetermined sequence of data items, which subset depends on the record of data repetitions, and converting the subset to the entire predetermined sequence of data items (field of stored data items). The record of data repetitions, referred to as tag information, is typically stored in a tag memory. Tag memory is a set of other memory locations, which may be located in a physically separate memory device (array) from the display memory, or in part of the same physical memory array.

More specifically, the reduction in bandwidth consumed by the display refresh process is achieved in two passes through the display data as follows. In the first pass e.g., (power on or reset), all the display memory is read and sent to the display. In this pass there is no reduction of memory bandwidth in the display refresh process. However, the data is also analyzed as it is being read, and is checked for any repetitions of the data in sequentially consecutive memory locations. Any repeat patterns are flagged and the tag information relating to such patterns is stored in the tag memory. In all subsequent passes, the tag information is retrieved and used to control the subsequent retrieval of display memory data items. Based on the tag information, subsequent data items for the display are generated (a) by accessing the memory for data items not known to be repeated values, or (b) by repeating the previous value if it is known to be a repeat. In the case of the subsequent sequential memory location not being read, the tag information is used to determine the next memory location that should be read to get the next non-repeated data item. This process results in reduction of the memory bandwidth for the display refresh process; yet the display receives the entire data stream as if it were all coming from the display memory.

Whenever, the contents of the display memory change, the corresponding portion of the tag information is marked as dirty or changed. This requires updating (or regenerating) the tag information. On the next pass through this display memory area during a display refresh process the data is analyzed and the tag information updated as described above. On subsequent passes the updated tag information is used to reduce the number of memory accesses. During the time that the tags are being regenerated, the refresh bandwidth reduction is suspended since all the data items are being read.

To reduce the "penalty" that occurs when the display memory contents are changed, the memory is divided into regions, referred to as tag frames, with each region being independently processed as described above. This division of the display memory results in the suspension of refresh bandwidth reduction being restricted to only the region of memory that was actually changed.

In one set of embodiments, the tag memory is a different memory array than the display memory. In a second set of embodiments, the tag memory and the display memory are both resident in the same memory array, either in different regions of the memory array or interleaved in the memory array.

In one of the first set of embodiments, the tag memory stores information related to the status of a tag frame of display memory such as the number of data repetitions. A display data value from the display memory is stored in a latch. The number of data repetitions of this data value is loaded into a down counter, and the display data value is output from the latch until the down counter indicates that there are no more data repetitions of the particular data value.

In another one of the first set of embodiments, the tag memory stores the next address location to be read. When a new data value is encountered, the location of the new data value is stored in the tag memory. Thus, a new tag address location corresponds to a new display data value. A display data value from the display memory is stored in a latch. The display data value is output from the latch until a comparator indicates a new tag address.

In one of the second set of embodiments the tag information is stored in an off-screen block of the display memory, and each data item has a tag bit that indicates if that item is the same as the previous item. A tag cache may be used to store tags for a given scan line, with transfers between the tag cache and the tag data block in the display memory occurring during the retrace interval. A dirty line buffer containing one bit per scan line may be used to keep track of whether the display data for that scan line has been modified since the last time the tag data for that line was generated.

In another one of the second set of embodiments, the tag information is interspersed. In a particular example, each block of 32, 32-bit double words (DWords) is preceded by a DWord containing the tag bits for the 32 DWords. The address generator in the display controller is preferably provided with address translation circuitry so that the CPU and other devices seeking access to the display memory can use addresses as if there were no interleaved tags. The circuitry maps raw addresses to physical addresses with appropriate gaps for the tags, and further generates appropriate tag addresses.

A further understanding of the nature and advantages of the present invention may be realized by reference to the remaining portions of the specification and the drawings.

DESCRIPTION OF THE DRAWINGS

FIG. 6E is a table of display data in its corresponding run length tag generated from the run length tag regeneration operation shown in FIG. 6D;

FIG. 6F is a timing diagram of the display data readback after a tag regeneration operation in the pipeline mode where tags are generated using the next address method;

FIG. 7 is a diagram of a tag frame during a tag invalidation operation in response to a random write to display memory where tags are generated using the down count method;

DESCRIPTION OF SPECIFIC EMBODIMENTS

System Overview

Figure 1:
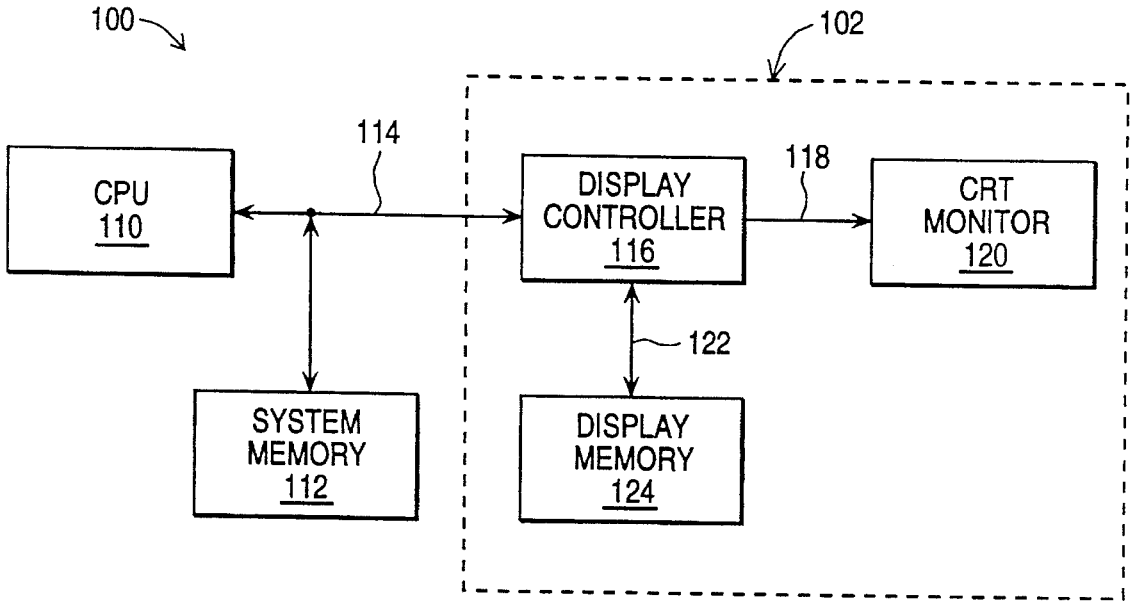
FIG. 1 (PRIOR ART)
FIG. 1 is a high level block diagram of a prior art computer graphics system including a display control system.
Figure 2:
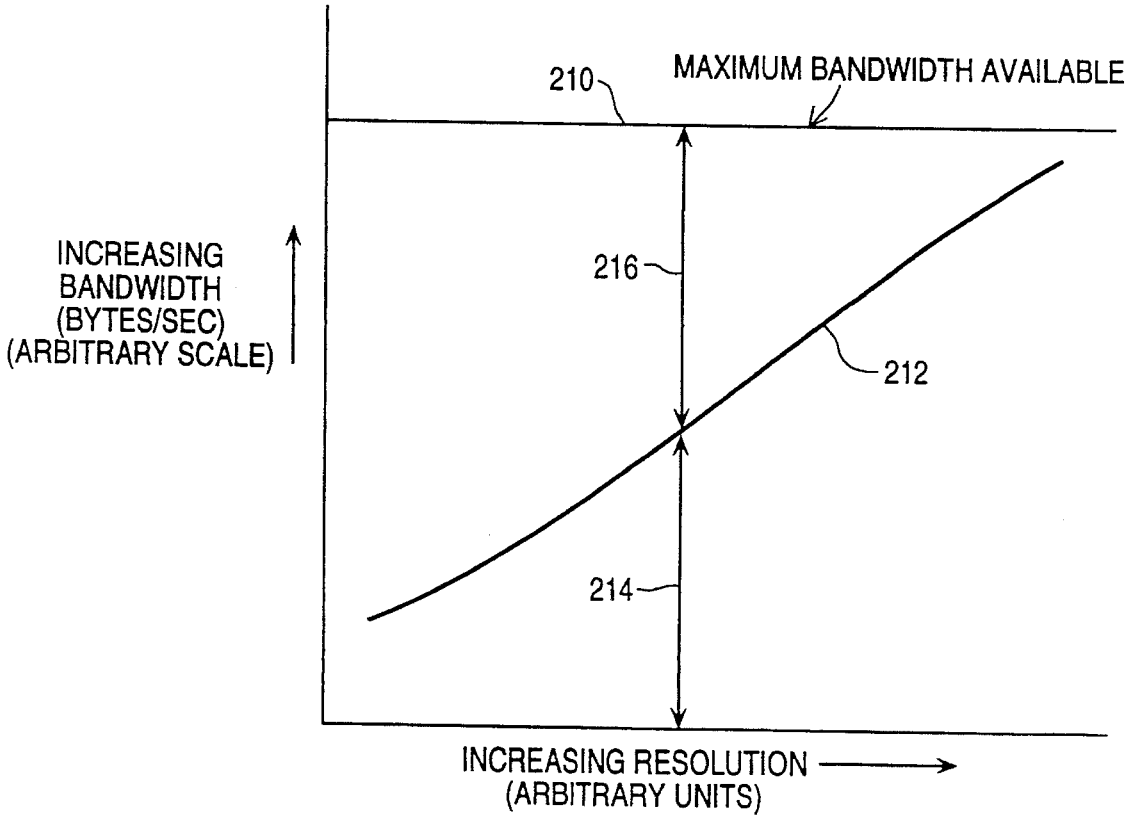
FIG. 2 is a graphical representation of the amount of bandwidth allocated for CPU to display memory transfers and display memory to CRT monitor transfers.
Figure 3:
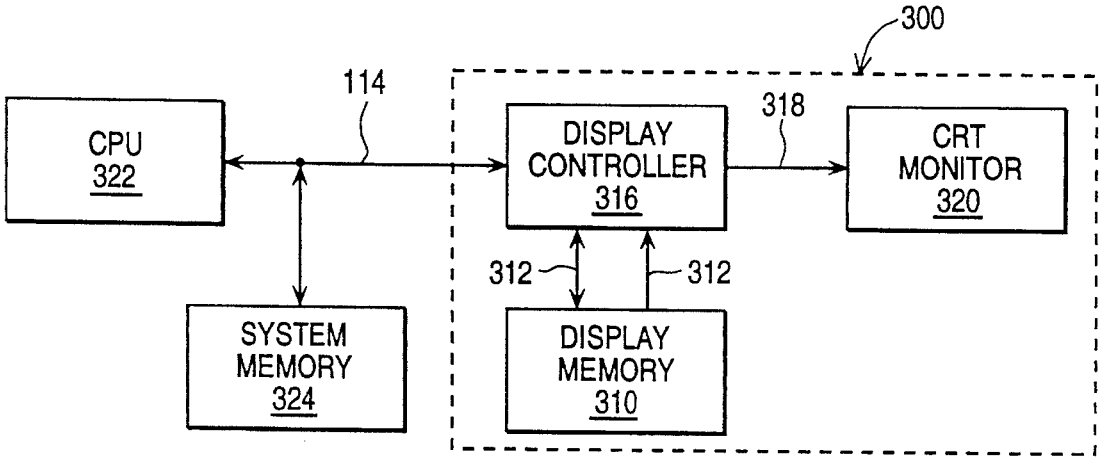
FIG. 3 (PRIOR ART)
FIG. 3 is a block diagram of a prior art computer system including a display system using a VRAM for display memory.
Figure 4A:
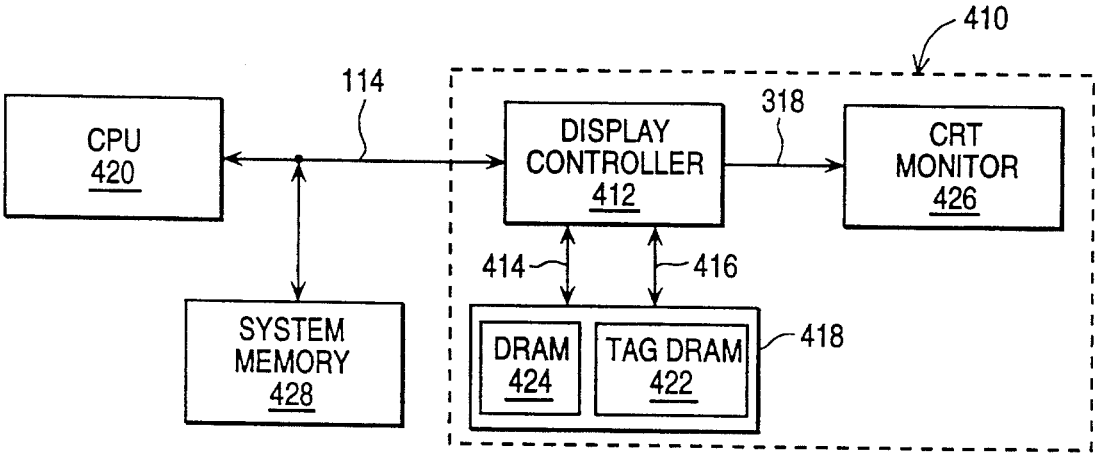
FIG. 4A is a high level block diagram of a computer system including a display control system according to a first set of embodiments of the present invention.

FIG. 4A is a high level block diagram representing one set of embodiments of a computer system according to the present invention. The computer system comprises a CPU 420 and a display subsystem 410. The display subsystem further comprises a display controller 412, a display subsystem memory 418, and a CRT 426. The display controller is typically integrated on a single chip. The display subsystem memory includes a conventional DRAM display memory 424 and a tag RAM 422. Two buses, 414 and 416, transfer data between the display controller 412 and display memory 418. In the preferred embodiment, bus 414 is a 32-bit bidirectional bus. Unlike the VRAM shown in FIG. 3, bidirectional bus 414 is not dedicated solely to CPU 420 to display memory 418 transfers. CPU 420 to display memory 418 and display memory 418 to the CRT monitor 426 transfers both occur on data bus 414. A second bidirectional data bus 416 is used for transfer of data to the tag RAM 422.

Although the term "tag" has become associated with cache memory, the term tag here is used in a different manner. When referring to cache data memory, the term tag refers to a coded value in cache memory which is used in determining whether the CPU should read data stored in cache memory to obtain the correct data value or whether the CPU should read a value from the main memory. In the present invention, the term "tag" refers to information stored in tag RAM 422 about a particular sequence of display data items in the display memory that make up a tag frame of data. Typically the items in the sequence are stored in a series of adjacent memory locations.

This tag information typically includes status information regarding the validity of the tags, and the number of data repetitions within a particular tag frame or the address of a first non-repetitive occurrence of a display data value in a tag frame. Like the "tag" in cache memory, the tag in the present invention is associated with a particular memory address. Also, similar to the tag associated with cache memory, the tag determines whether DRAM memory is to be read. In the case of cache memory, there is no need to retrieve the data from the system memory if a match occurs; in the case of the tag RAMs of the present invention, display memory must always be read; however, there may be no need to retrieve subsequent data.

The system shown in FIG. 4A reduces the number of memory cycles between the display memory and display controller on bus 414, which provides more bandwidth allocation to competing processes. The present invention takes advantage of the fact that (1) data is transferred to the CRT from consecutive data memory locations and (2) that data being displayed is typically very repetitive. For example, data displayed on a CRT monitor for a word processing program typically includes blank data lines between text and blank spaces along the border of the text. Thus, the data which fills in the background of the screen is highly repetitive. The present invention keeps track of the number of times data is repeated. In specific embodiments, it stores the number of data repetitions (one less than the number of consecutive occurrences), or the address of the first occurrence of a new data value in tag RAM 422. No display memory access to output data to the CRT screen occurs during the times when data is repeated. The leftover cycles where display memory is not accessed increases display memory bandwidth which may then be used for CPU to display memory or additional display memory to CRT transfers.

Figure 4B:
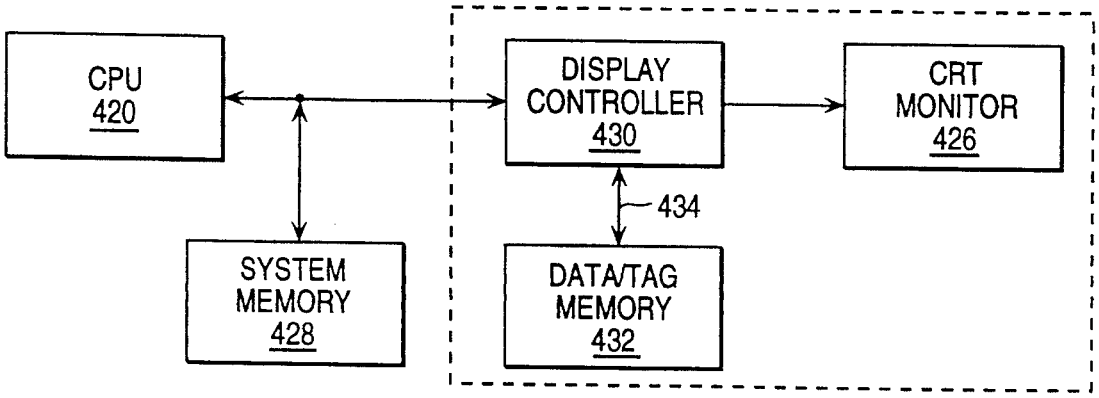
FIG. 4B is a high level block diagram of a computer system including a display control system according to a second set of embodiments of the present invention.

The first two embodiments to be described in detail below use a separate memory array (the tag RAM) to store the tag information, and differ in the particular representation of data repetitions (number of repetitions vs. address of a first non-repeating value). A second set of embodiments store the tag information in the same memory array as the display information. This is shown schematically in FIG. 4B where a display controller 430 communicates with a combined data/tag memory 432 over a single bidirectional bus 434.

Memory Organization

Figure 5A:
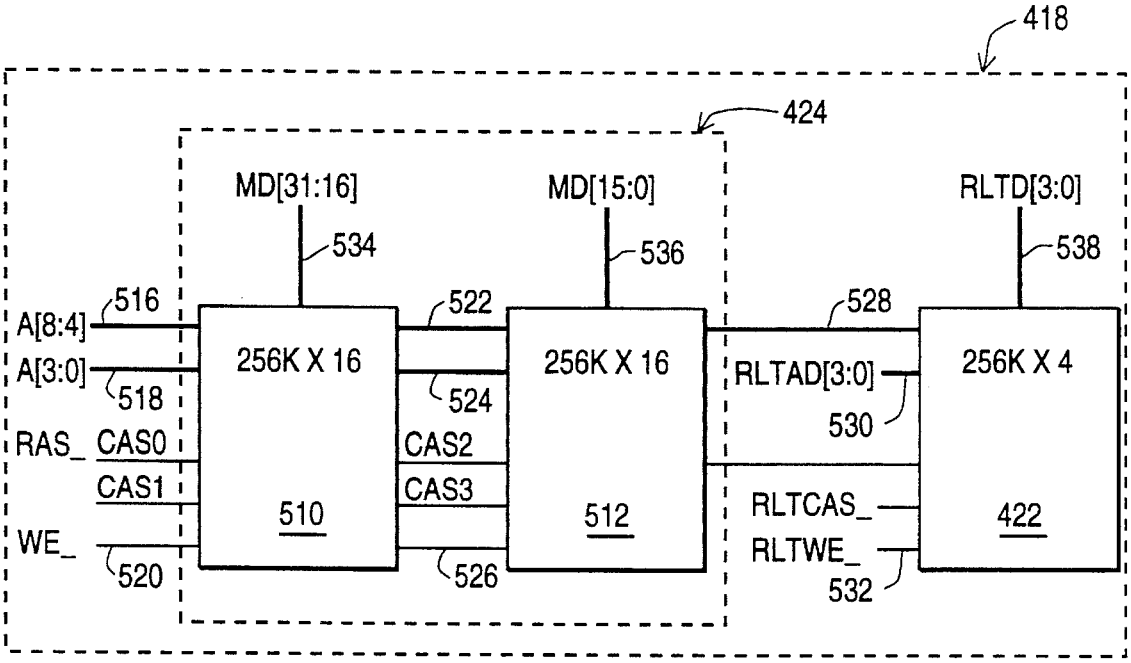
FIG. 5A is a block diagram of the display memory subsystem according to the first set of embodiments of the present invention.
Figure 5B:
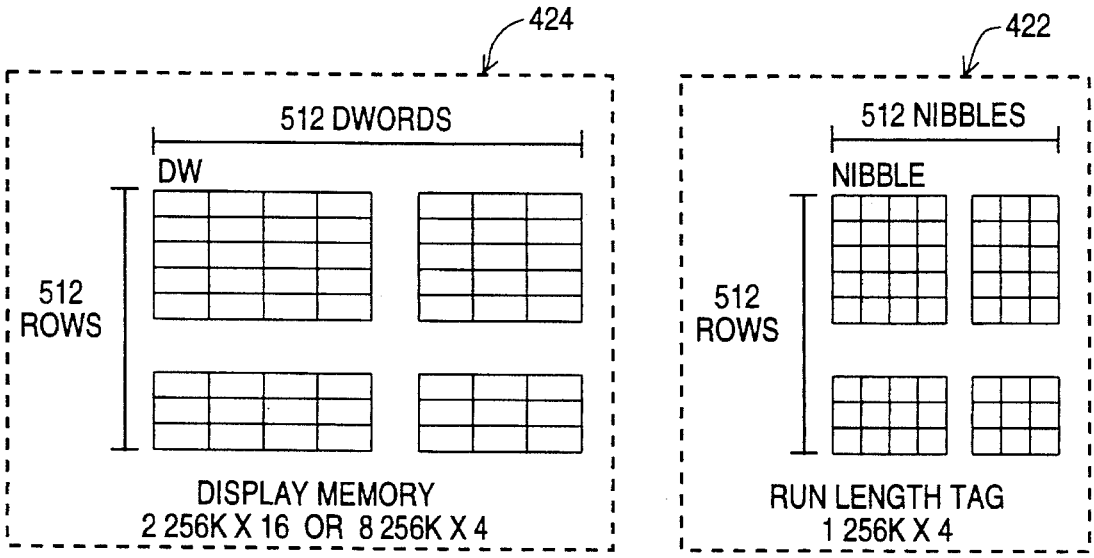
FIG. 5B is an expanded block diagram of the display memory and tag memory organization according to the first set of embodiments of the present invention.

FIGS. 5A and 5B illustrate the display memory interface for a system according to the first set of embodiments, and based on a 32-bit architecture. FIG. 5A shows the physical hardware, while FIG. 5B shows the logical organization. In the specific embodiment of the present invention, display memory subsystem 418 consists of two 256K×16 DRAM chips 510 and 512 connected to a third 256K×4 DRAM chip 422. DRAM chips 510, 512 constitute a memory array that defines display memory 424. DRAM 422 constitutes an additional memory array that defines the tag memory.

DRAM 510 stores data corresponding to the most significant 16 bits of the 32-bit display data word. DRAM 512 stores data corresponding to the least significant 16 bits of the 32-bit word. As a matter of nomenclature, a 32-bit entity will be referred to as a double word, or more often as a DWord. A 9-bit address A[8:0] is transmitted to DRAMs 510 and 512 on address lines 516, 518 and address lines 522, 524 respectively.

The uppermost five address bits of the address A[8:4] are common to DRAMs 510, 512 and also to tag RAM 422. The uppermost five bits are input into DRAM 510 on address bus 516, to DRAM 512 on address lines 522, and to the tag RAM 422 on address lines 528. The four lowest bits of address A[3:0] are common input to DRAMs 510 and 512 on address lines 518 and 524. These lowermost four address bits are not common to tag RAM 422. Instead a 4-bit run length tag address RLTAD[3:0] is input on address lines 530.

Both the display and tag memory locations share the same frame address A[8:4] but may be at different locations in the tag frame. This is accomplished by having the four LSBs of the tag address bits RLTAD[3:0] be independent from the four LSBs of the display address A[3:0]. Thus the display and tag address pointers can be at different locations within the same tag frame.

In one embodiment, the number of tag address data lines RLTAD[3:0] is equal to 4 and determines the maximum number of address lines available for a tag frame of data. Thus, in this embodiment, the maximum number of contiguous data memory locations is equal to 16 or $2^4$. Also, since only four bits are available in the tag data memory locations for storage of the run length tag, only values from 0 to F may be represented in the tag data memory location. In an embodiment of the present invention using the down count method, a 0 is indicative of a first occurrence of consecutive data. A value of E represents the fifteenth occurrence of the same data item. A value of F is used to represent invalid frame tag data.

A common write enable signal is input into DRAMs 510, 512 on address lines 520, 526 respectively. A separate run length tag write enable signal is input into tag RAM 422 on line 532. Having independent write enable signals for display memories 510, 512 and the tag memory 422 allows the display memory 510, 512 to be read and the tag memory 422 to be written simultaneously. This is important because the tag data for a frame needs to be able to be regenerated (rewritten) while the display data is being read.

The data output on lines 536 and 534 of display memory 424 make up a 32-bit DWord corresponding to data block 424 in FIG. 5B. Each display memory address corresponds to a 32-bit DWord in block 424. Data block 424 includes 512 rows and 512 columns of 32-bit DWords. The data output on line 538 makes up a 4-bit data word corresponding to data block 422 in FIG. 5B. For each DWord in block 424, there is a corresponding nibble (4 bits) in tag RAM 422.

Tag Overview

Figures 6A, 6B:
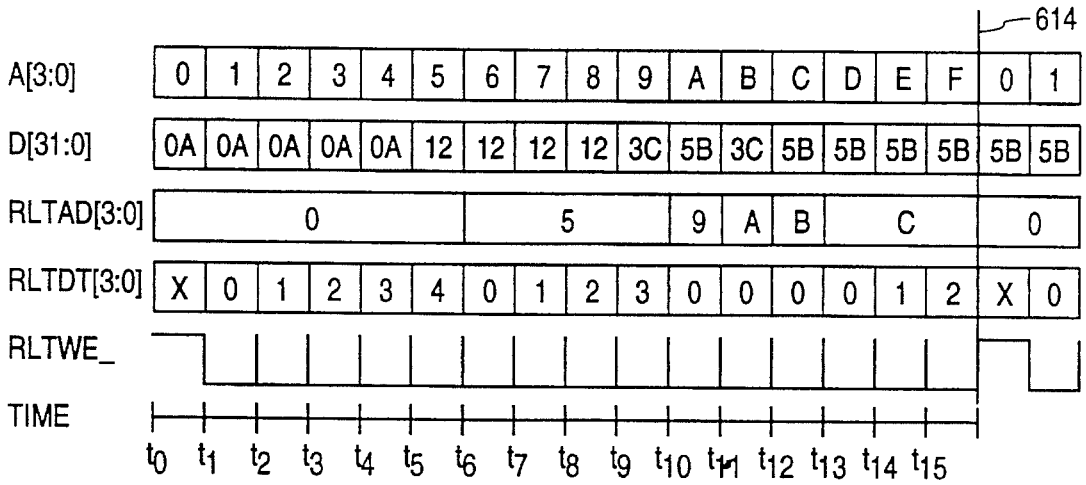
FIG. 6A is a timing diagram corresponding to a tag regeneration operation in the pipeline mode where tags are generated using down count method.
FIG. 6B is a table of display data and its corresponding run length tag generated from the run length tag regeneration operation shown in FIG. 6A.
Figure 6C:
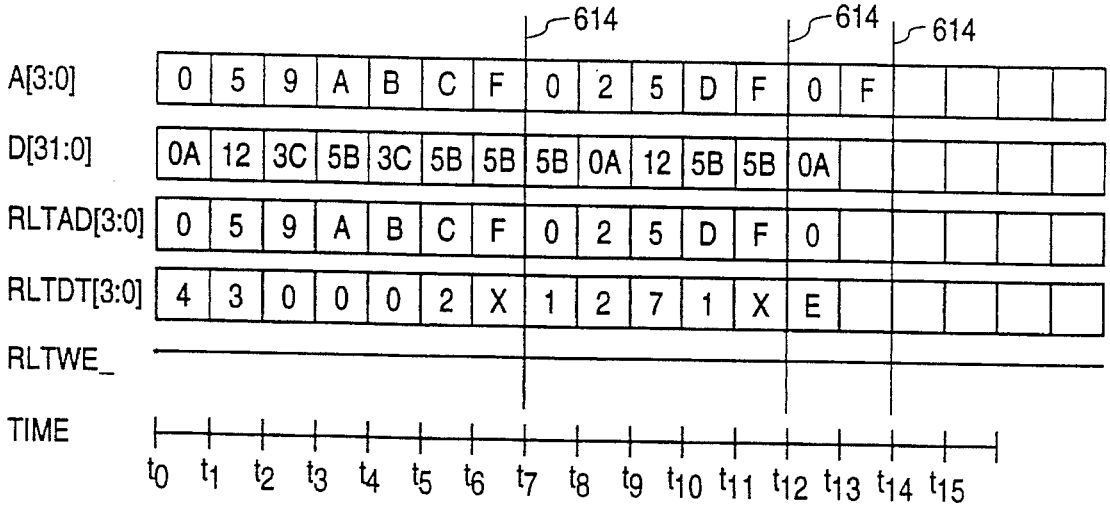
FIG. 6C is a timing diagram of the display data readback after a tag regeneration operation as shown in FIG. 6A.

FIGS. 6A–6F show the way tags are generated and stored; FIGS. 6A–6C deal with the embodiment that stores the number of data repetitions, while FIGS. 6D–6F deal with the embodiment that stores the address of the next new value.

Tag regeneration defines the mechanism of tag value generation or regeneration. When power is turned on or the system is re-initialized, data in tag RAM 422 is ignored and the run length tag data in every frame must be generated globally because no assumption can be made regarding the contents of display memory 424. Beyond the point of system reinitialization and the first global tag generation pass, tag regeneration occurs on a frame by frame basis only if an invalid frame tag condition is detected. The present invention keeps track of the number of data repetitions within a frame (defined as a block of 16 DWords), which implies that the first location of a frame will always be read. Consequently, a tag value of "F" in the first location of the frame will be used to indicate the "frame invalid condition." This is depicted in FIG. 6A where the tag write enable signal RLTWE_ is high indicating a read at the beginning of the tag frame.

The first display data value is the first occurrence of the display data value and is associated with a run length tag value, or alternatively a tag count value of zero. The first display data value is compared to the next display data value in the tag frame to see if a repetition of the data value occurs.

If the display data value is repeated, the tag count is incremented to indicate another occurrence of the same display data value.

In these embodiments, a tag frame is a series of 16 (0 to F) sequentially read memory locations. FIG. 6B illustrates two full tag frames followed by a partial tag frame. In FIG. 6B a first full tag frame corresponds to address locations 000 to 00F. A second full tag frame corresponds to address locations 010 to 01F. The boundaries between the adjacent tag frames are represented by lines 614 in FIGS. 6A, 6B, 6C, 6E, and 6F.

FIG. 6B is a table of display data and its corresponding run length tag data. Column 616 is the display memory and tag memory address. Note that although display data and its corresponding tag data are accessed by the same address (column 616), the display memory and tag memory locations are independent of each other within the tag frame since only the 5 MSBs of the address A[8:0] are shared.

Referring to FIG. 6B, column 618 shows the 32-bit display data value stored in the display memory 424 having the address associated with column 616. Similarly column 620 shows the 4 bit run length tag value stored in tag memory at the associated address in column 616. For the example shown in FIG. 6B, when the address "000" is input into display memory 510, 512 the value read is "0A". When an address "000" is input into TAG memory 422, a value of 4 is read.

Referring to the timing diagram shown in FIG. 6C, bits A[3:0] refer to the four LSBs of the display data memory address and bits RLTAD[3:0] refer to the four LSBs of the tag data memory address. D[31:0] is the value of the 32-bit DWord stored in display memory 510, 512. RLTAD[3:0] is the location of the run length tag address pointer within the tag frame (0 to F). RLTDT[3:0] is the value stored in tag memory at the address RLTAD[3:0]. The signal RLTWE_ indicates whether the display controller is reading or writing to display memory. Each time the display address pointer reaches the boundary 614 between tag frames 622, the display address and tag address pointers are positioned to point to the beginning of the tag frame.

The following description of tag regeneration refers to two methods which can be used in implementing the present invention. The primary difference between the two methods relate to the value stored in the tag RAM. In the down count method, the count of the consecutive occurrences of a display data value is stored in the tag RAM. In the next address method, the addresses of the non-repetitive occurrence of display data values is stored in the tag RAM.

Tag Regeneration - Down Count Method

In the example shown in FIG. 6A–C, the first display data value in the tag frame (address location 0) is 0A; the first tag data value is 4. Initially (at time $t_0$) the value stored in the tag RAM address 0 is an "X" which is representative of a don't care value. At time $t_0$, the display controller reads the value "0A" and stores it for future comparison. At a later time $t_1$, a value of 0 is stored in the tag RAM address location 0 to indicate the first occurrence of display data value 0A. After reading frame 00 address 0, the display controller 412 reads frame 00 address location 1. In the example shown in FIGS. 6A–C, since the display data value is 0A in both display address locations 000 and 001, the value in the tag RAM 422 is incremented. Display memory address location 002 similarly contains a 0A data value and the tag data value RLTDT[3:0] is incremented to a value of 2 to indicate a third consecutive data occurrence. This process is repeated until display address location 005. After the display data value 0A occurs five consecutive times, a value of 4 is written into the tag RAM at tag address location 0.

At display memory address location 005, the contents of the display data memory change from a value of 0A to 12. The tag address pointer, which had previously been pointing at frame 00 address location 0, is bumped to tag address location 5. Tag address locations 1–4 are shown filled with X's which indicate a don't care state. These tag data locations are not written and will be skipped by display controller 412 when scanning the tag values on the next pass during display data readback.

Since at display address location 005 the display data changes in value, the run length tag regeneration circuitry starts the process of counting consecutive occurrences of data again. Since there are four consecutive occurrences of the value 12 in display data memory (see display memory address locations 005–008), the count value in the tag RAM 422 at frame address 00 location 5 is incremented until it reaches a value of 3. The next change in the value of display data memory occurs at address location 009. Since the value 3C occurs only once, a value of 0 is stored in the tag RAM 422 at tag address location 9. Similarly, a value 5B occurs only once and again a value of 0 stored in the tag RAM 422. At display address location 00B a display data value of 3C occurs once again and a value of 0 is stored in the tag RAM 422 at tag address location B.

Beginning at display address location 00C, another series of repetitive display data values occurs. At address location 00C the first occurrence of the display data value 5B occurs. At time $t_{13}$ a tag data of zero is stored in the tag RAM 422 to indicate the initial occurrence of value 5B and a second value 5B is read. At time $t_{14}$ the run length tag value is incremented to a value of 1 (corresponding to the value read at address location 00D) and a third consecutive display value of 5B is read. At time $t_{15}$ the run length tag value is incremented to a value of 2 (corresponding to address location 00E) and a fourth consecutive display value 5B is read.

In the pipeline mode, another write to the tag RAM 422 does not occur until the next frame when address location 001 is being read. Therefore, tag address location F is never written to; thus, at a minimum, the system is required to read both the first and last address locations in a tag frame.

Tag Regeneration - Next Address Method

Figure 6D:
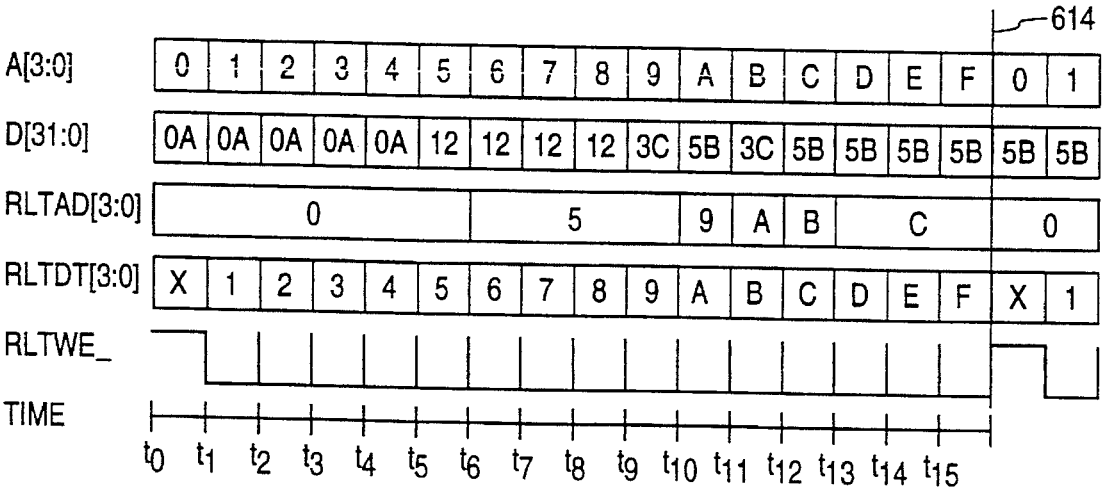
FIG. 6D is a timing diagram corresponding to a tag regeneration operation in the pipeline mode where tags are generated using the next address method.

The examples shown in FIGS. 6D–6F illustrate run length tag regeneration according to the next address method. The next address method is similar to the down count method illustrated in FIGS. 6A–6C. However, the data value stored in the tag address location in the down count method is the count of the number of repetitive sequential display data values. In the next address method, the value stored in tag RAM is the tag address value of the next address to be fetched.

The display data shown in FIG. 6E for the new address method is the same display data shown in FIG. 6B for the down count method. However, the tag generated corresponding to this display data is different. In both cases the display data values in display memory location 000–004 is the value 0A. However, the tag generated in the down count method is a value of 4, reflecting the number of repetitions while the tag value generated using the new address method implementation is a value of 5, which reflects the next address where there is a new value.

In the example shown in FIGS. 6D–6F, the first display data value in the tag frame (address location 000) is 0A; the first tag data value (at tag address location 0) is 5. In the new address method, the tag data value (RLTDT [3:0]) referred to in the down count method illustrated in FIG. 6A now tracks the address A[3:0] which points to the next display address to be fetched. Thus at time $t_1$, the address value 1 is stored in tag address location 0. Similarly at time $t_2$, the address value 2 is stored in tag address location 0. The tag address value RLTAD[3:0] does not change in value until the display data value D[31:0] changes in value.

At frame 00 address location 5, the contents of display data memory change from the value 0A to 12. The tag data value RLTDT[3:0] which is currently storing a value of 5 is written into the tag address location 0 during the next time period $t_6$. The tag address locations 1–4 are shown filled with X's which indicate a don't care state. These tag data locations are not written to and will be skipped by the display controller 412 when scanning the tag values on the next pass during the display data read back. The value 5 indicates that the display address pointer should go to tag address location 005 to find the next display and tag data.

At display address location 005 the display data changes in value, and the run length tag regeneration circuitry starts the process of comparing consecutive occurrences of data values again. The tag logic circuitry stores the display data value of 12. At times $t_6$ through $t_8$ the value of 12 remains the same and the tag address value RLTAD [3:0] does not change. The next change in the value of display memory occurs at address location 9. At time $t_9$ the display data value D[31:0] changes in value from a value 12 to the value 3C. When the value changes, the frame address A[3:0] and the tag data value RLTDT[3:0] are at frame address location 009. Thus, a value of 9 is stored in tag address location 005 to indicate that the frame address 9 is where the next display data value change occurs.

Beginning at address location 00C, another series of repetitive display data values occurs. At address location 00C the first occurrence of the display data value 5B occurs. At $t_{13}$ a tag data value of D is stored in the tag RAM 422. At $t_{14}$ a tag value of E is stored in tag data memory. At $t_{15}$ a tag value of F is stored in tag data memory. Since the next time interval following $t_{15}$ corresponds to a new frame of data, the tag address pointer and display address pointer point to the beginning of a new tag frame.

FIG. 6E is a timing diagram of the display data readback after the tag regeneration operation shown in FIG. 6D. When the display controller 412 begins scanning a new tag frame after regeneration, it begins with both the display address and tag address pointers at frame address location 0. Reading the contents of tag address location 0, the display controller knows that the data value (0A) stored in display address location 000 is repeated during the next four locations. The tag address value of 5 notifies the display controller that the next new non-repetitive data value is stored at display address location 005. Since the display data value is repeated, the display controller address pointer skips to tag address location 5 to find the new data and the address of the next non-repetitive data value. There is no need to check the tag data values between tag address location 0 and 5.

At address location 005 a value of 9 is stored in tag data memory. Thus, the display controller points to address location 009 to find the next non-repetitive data value. Similarly, the display controller points to address locations A, B, C, and F. The display data value of F is always stored in the run length tag since the last data location is always read.

Tag Invalidation Operation

Tag invalidation defines a mechanism by which a tag is invalidated due to a change in the display data value in a tag frame. Typically a tag invalidation operation occurs when the CPU has changed the display data value in the interim since the last run length tag value was generated. This occurs, for example, during a CPU write to a location in display memory.

The following example of a tag invalidation describes tag invalidation where the down count method was used for tag formation. The down count method is similar to the next address method with the exception of the value stored in tag memory. In the down count method, a value of "F" represents a "dirty tag" value; in the next address method a value of "0" represents a dirty tag.

FIG. 7 shows a tag frame after a tag invalidation operation. In the example shown in FIG. 7, a CPU write has occurred at frame 00 address location 5. Whenever a CPU write occurs, the 4 LSBs of the tag address are forced to 0 and a tag data value of F is written into tag address location 0. The CPU write to display address location 005 occurs within the same time period as the tag write at tag address location 0 so that no additional overhead is necessary.

The tag value of F, also referred to as a "dirty tag", is used to indicate that the tag frame data and the corresponding tag frame is invalid. A tag value of F causes a tag regeneration operation to be performed on the tag frame the next time the tag frame is sequentially accessed. Since the dirty tag is set at the first location of the tag frame, the tag address is always read. This is important since as shown the CPU may write anywhere within the tag frame and not just at the tag frame boundaries. For example in FIG. 7, if the previous data in the tag frame had consisted of eight consecutive data values of 1 (in tag frame addresses 0–7) followed by 8 consecutive values of 2 (in tag frame addresses 8-F), the corresponding tag frame would have a value of 7 stored at tag address location 0 and a value of 6 at tag address location 8. Note that a value of 6, not 7, is stored at tag address location 8 even though the same data item occurs 8 times. This is because the last tag address location is always read.

If during a CPU write, a different value of 3 was written into display data memory location 005, a value of F written at tag address 5 to designate that data display has been corrupted would not be read the next time memory is sequentially accessed. Since the tag address location 0 would still indicate that the next 8 consecutive data values in the tag frame are repetitive, the tag address pointer would simply skip to address location 8, skipping over the newly changed data value stored in tag address location 005.

The problem with a random CPU update of that location is the fact that the tag scheme is completely transparent to the CPU. Therefore the tag for the corresponding location may not be updated with the appropriate value without a loss of sequence. Calculating the appropriate tag value requires the CPU to know the data contents of all 16 locations of the frame. In the above example, the new data will be skipped over. However, another case occurs if the previous tag points to the new location and the erroneous tag data was stored at the corresponding location to point to a non-valid location marked with a don't care value X. Therefore, the only deterministic way to handle the aforementioned cases would be to invalidate the frame and let the next pass of sequential accesses update the whole tag frame data.

As can be seen in FIG. 7, the display controller may be pointing to tag address location 5 for a CPU write while the tag address pointer is at tag address location 0. Thus, the CPU may write simultaneously to address location 5 in memory block 424 while the tag address pointer writes a value of F at tag address location 0 in memory block 424. Although the worst case scenario for a tag invalidation would be regeneration of every frame, this does not degrade performance compared to the prior art since tag writing can be performed simultaneously with display reading.

Tag Aware Operation

The tag aware operation is a process that regenerates the run length tag value and restores the sequence for the memory locations that were updated. Thus, after a tag aware process, tag regeneration is not necessary. One example where a tag aware process occurs is during a bit block transfer (BITBLT). There are two standard types of BITBLT transfers: (1) from the system CPU to display memory and, (2) from video to video. A system to display memory BITBLT occurs when the CPU dumps a block of data from system memory to display memory. A video to video BITBLT is a CPU initiated transfer where a data block within the display memory is transferred to another location within display memory. In other words, the display controller reads from the source and writes to the destination.

Since tag regeneration makes more bandwidth available to the CPU, more time is available for the CPU to move blocks of data. Unfortunately, increased data block movement increases the number of dirty tags and decreases system efficiency. A dirty tag will cause a regeneration operation the next time the memory location is sequentially accessed. The tag aware operation regenerates the tag, whenever possible, so as to not create a dirty tag frame of data.

A BITBLT operation can (1) cross tag frames and (2) be any number of tag frames designated by the CPU. The technique used by the present invention, looks at each tag frame to determine which of three classes it falls within. The tag frame is classified as a partial block start, partial block end, or full tag frame.

By definition, a BITBLT operation includes transfer of at least one start frame and one end frame although they may be the same frame. At any point in time, a run length tag is a function of the (1) destination data, (2) destination address or the (3) previous destination data. Unlike the tag regeneration operation, the BITBLT tag update writes to the destination data while simultaneously updating the tag data (simultaneously generating tag). Thus when finished writing to the tag frame, a new clean set of tags has been generated.

Figure 8A:
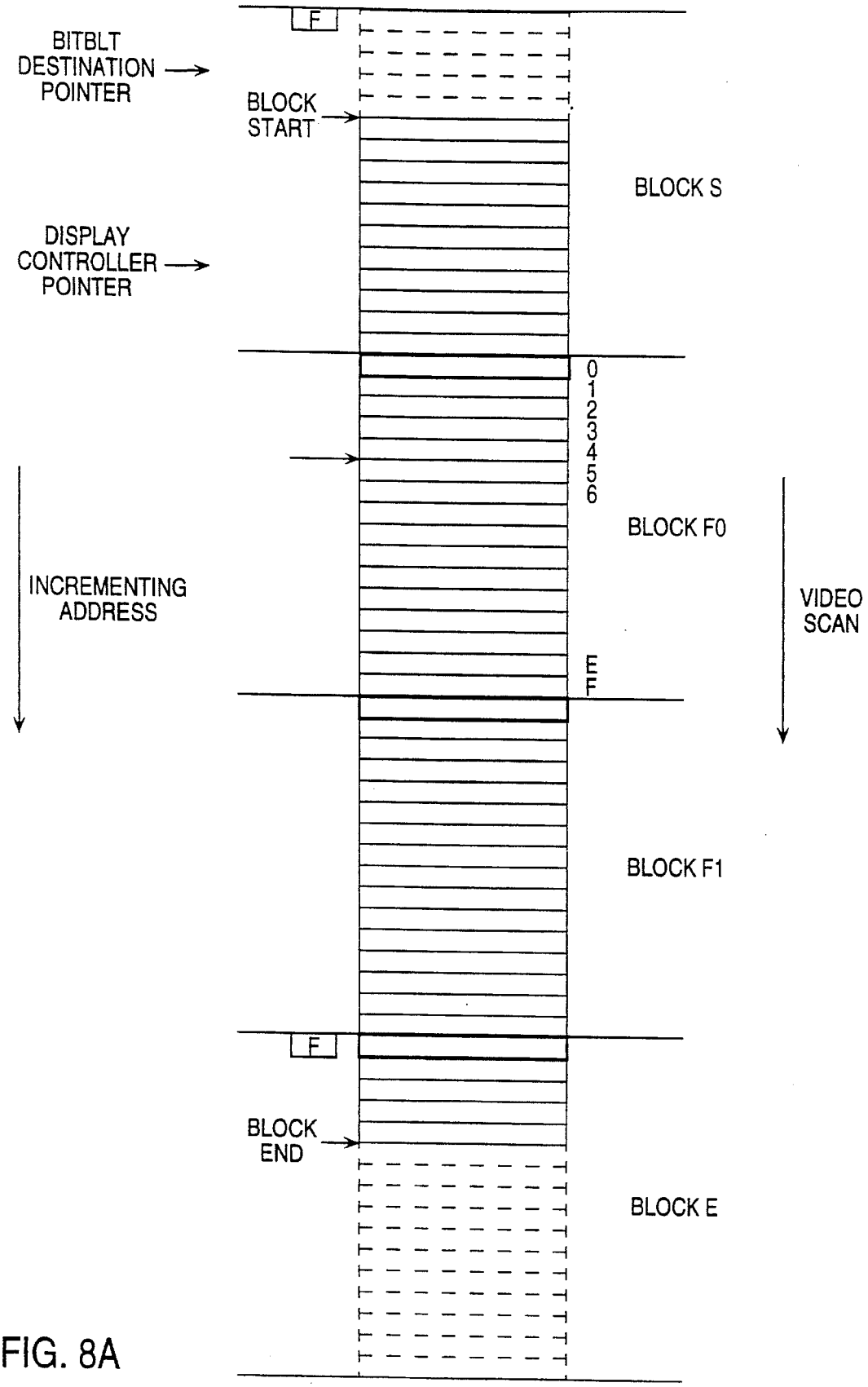
FIG. 8A is a tag frame diagram corresponding to a BITBLT tag update operation in the pipeline mode where the BITBLT is in a incrementing address mode and tags are generated using the down count method.
Figure 8B:
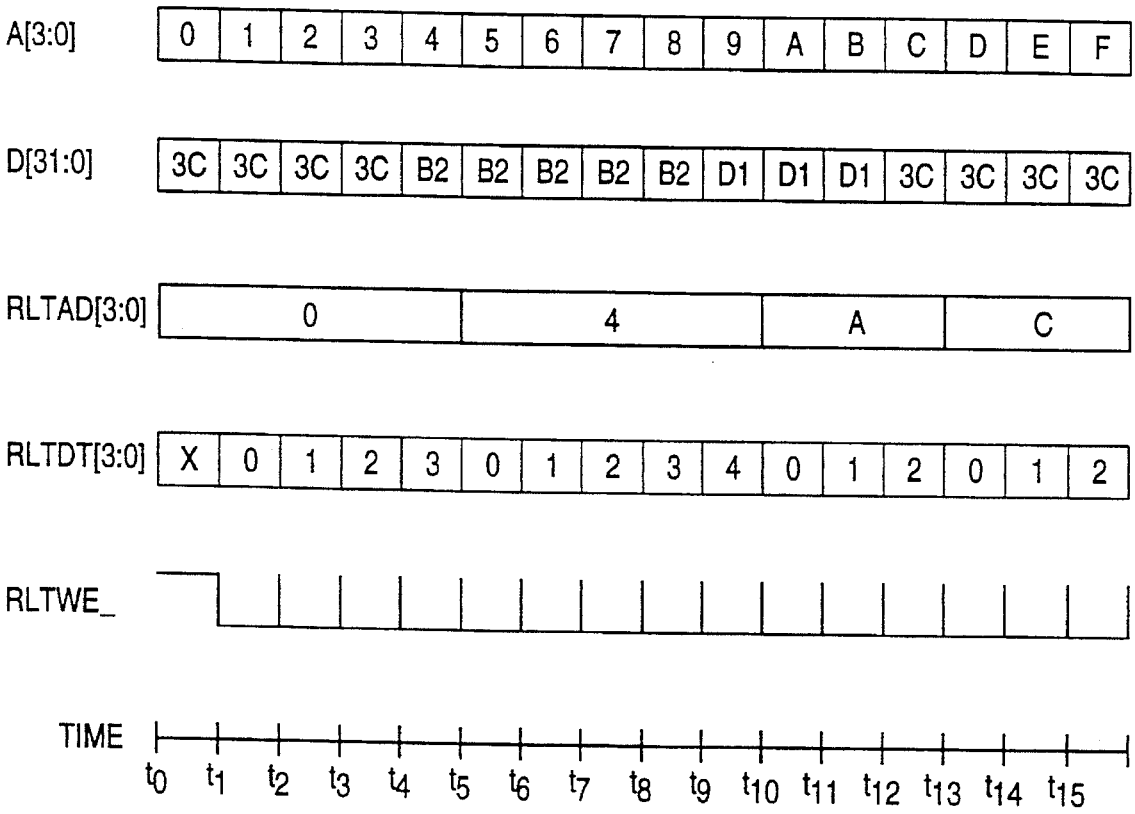
FIG. 8B is a timing diagram corresponding to the BITBLT tag update operation in the pipeline mode associated with the tag frame in FIG. 8A.

FIGS. 8A and 8B illustrate a BITBLT operation in the pipeline mode where tags are generated using the down count method. This example shows a start tag frame, two full tag frames, and an end frame of data for a BITBLT. The block start and block end frames are treated differently than a full tag frame. Unlike data in a full tag frame, tag data in the block start and block end cases is not a function of previously accessed data. In the block start and block end case, the display controller does not know what happened prior in the sequence. Since previous data values are unknown, a value of F is written into tag address 0 of the block start and block end frames. The Block Start and Block End frames are invalidated in the same manner as the random access CPU write in display memory for a Tag Invalidation operation. (In the next address method, a value of 0 would be written to tag address 0 to indicate invalidation.) The automatic regeneration will update during the next display cycle upon detection of a value F in tag address 0. In the present example, a value F in tag address 0 always means ignore tag data for the next consecutive 16 accesses (locations) and perform a tag regeneration.

Similar to the regeneration operation, when the BLT destination pointer is in a full frame (case 2), the tags are updated along with the destination data. However, a special case occurs when the display controller interrupts the BLT stream. If the display controller interrupts the BITBLT operation in the middle of the frame, then the tag data should be ignored and a regeneration should not be performed.

For example, if an interrupt occurs during tag generation of block $F_0$ at tag address location 4, although the data stored for the first five locations may be good, the tag data stored for the remaining frames may be invalid. This is because there could still be old tags in tag data memory locations which are from the previous tag generation. Since tag data may be corrupt, the tags in that tag frame have to be ignored until a full frame of data has been completed. Thus, when the BITBLT operation is interrupted in the middle of a tag frame, the run length tag data should be ignored and a regeneration operation should not be performed.

In order to determine if the tag data should be ignored, the BLT destination pointer is compared to the display address pointer. If the display address pointer and the BLT destination pointer are in the same tag frame, the tag data may be invalid and thus the display controller should read each display data value in that tag frame. Thus, the run length tag values should be ignored and no regeneration should be performed. Once the system is finished servicing the display controller interrupt, the system continues servicing the BITBLT transfer. The BITBLT circuit keeps track of where the last BITBLT transfer occurred.

Figure 9A:
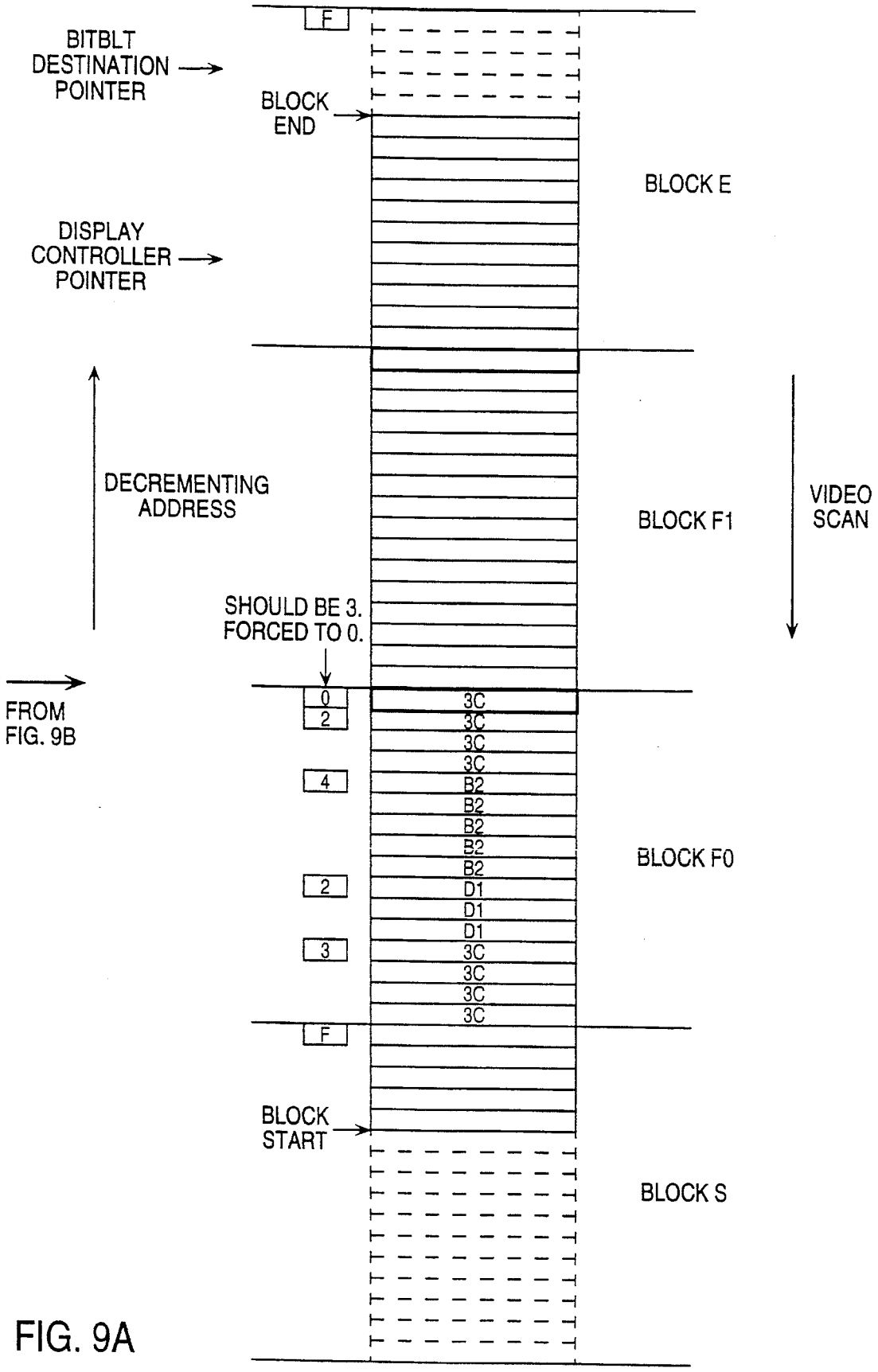
FIG. 9A is a tag frame diagram of a BITBLT tag update operation in the pipeline mode where the BITBLT is in a decrementing address mode and tags are generated using the down count method.

FIG. 9A shows a start tag frame, two full tag frames, and an end tag frame for a BITBLT tag update operation in the pipeline mode. In this example, the video scan is incrementing while the BITBLT occurs in a descending order. When the BLT destination pointer is in a start or end block, the BITBLT tag update operation is treated the same as when the address is incrementing (see FIGS. 8A and 8B). That is, when in the start or end block, a value of F is written into tag address location 0. The automatic regeneration operation will update the tag frame during the next video scan upon detection of a value of F in tag address location 0.

When the BITBLT destination pointer is in block $F_x$ having a full tag frame, the tags are updated similarly to the BITBLT tag update for incrementing addresses shown in FIGS. 8A and 8B with one essential difference. In the example shown in FIGS. 8A and 8B, the tag address pointer is bumped to a new tag address location when the contents of the display memory have changed in value. In contrast, in the case where there is decrementing BITBLT address, tag address data is written into each tag data memory location. The tag address pointer is incremented by 1 after writing into tag data. This can be seen clearly from the timing diagram shown in FIG. 9B.

Pipeline Mode

Figure 9B:
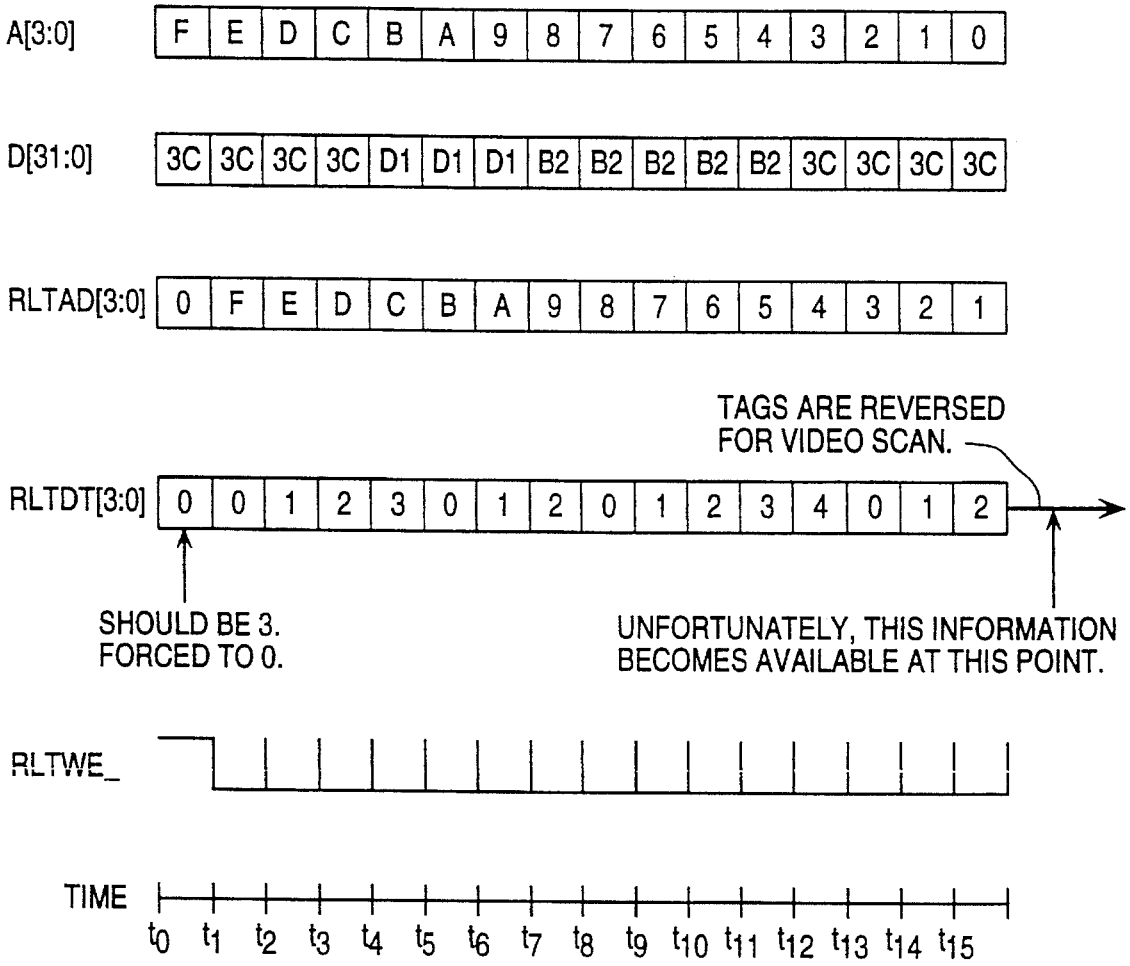
FIG. 9B is a timing diagram corresponding to the BITBLT tag update in FIG. 9A in the pipeline mode where the BITBLT is in a decrementing address mode.

In the example shown in FIGS. 9A and 9B, tag generation and BITBLT update are done in the pipeline mode. Pipeline operation relaxes the circuit timing requirements as the system is writing the tag for the data read in the previous cycle. This is the best approach for display controller tag regeneration so as not to have to extend the memory read cycle. Extending the memory read cycle reduces system efficiency. For a pure source to destination BITBLT, the source data is available internally and the tag could be generated in time for the memory write. Therefore, non-pipeline operation could be applied without having to extend the memory access cycle.

Figure 10A:
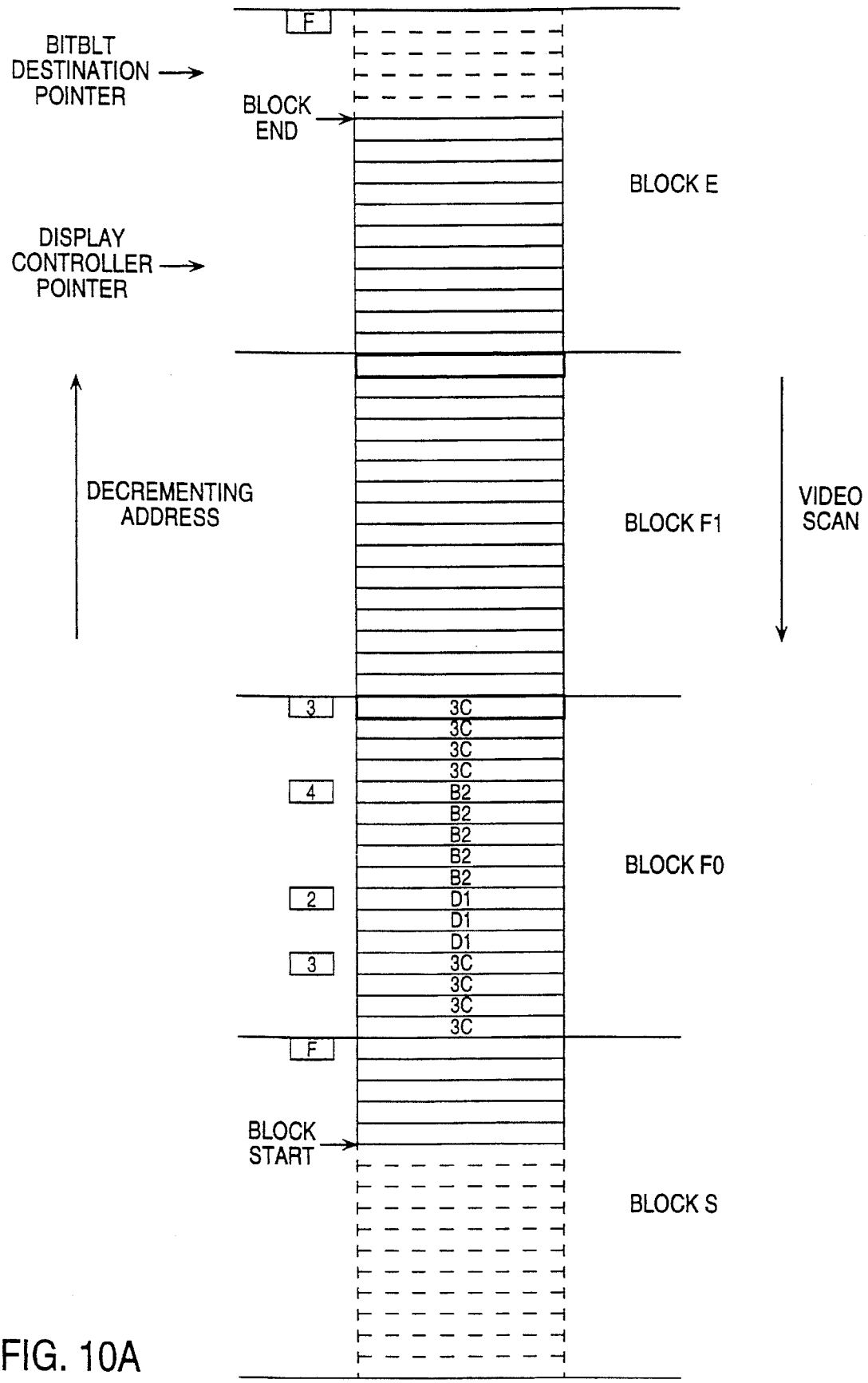
FIG. 10A is a tag frame diagram for a BITBLT tag update operation in the non-pipeline mode where the video scan is in a decrementing address mode and tags are generated using the down count method.

Referring to FIG. 9A in the case of a decrementing address, the tag pointer begins the tag frame pointing at tag address location 0 instead of pointing at tag address F as in the case of a non-pipeline decrementing BITBLT transfer as shown in FIG. 10A. In the example shown in FIG. 9A at time $t_0$, the tag address RLTAD[3:0] is at location 0 while the display address pointer is pointing to frame address location A[3:0] at location F. A data value of 0 is stored at tag address location 0 due to timing constraints in the pipeline mode. In general, BITBLT operation might require a read-modify-write cycle on the destination. This would delay the tag generation until after the read data has become valid from the memory and pipeline mode is recommended in this case. It is worth noting that in the case of decrementing BITBLT address, pipeline mode forces a write of tag data 0 into tag address 0 thereby requiring the second value to always be read. This is not a constraint for non-pipeline mode as is apparent in the case depicted in FIG. 10A.

At time $t_0$, the value of 3C is read from the display memory address corresponding to frame address F. Since this is the first time the value 3C is encountered, a value 0 is stored in tag address location F to indicate the first occurrence of the data value. The value 0 is not written into tag address location F until time $t_1$ due to pipeline constraints. A second value of 3C occurs at the display memory address E. The run length tag value is incremented to a value of 1 to indicate that two occurrences of the value 3C have occurred. However, unlike the example shown in FIGS. 8A and 8B, the tag address pointer is decremented so that instead of writing a tag value of 1 into address location F, the tag value of 1 is stored at tag address location E.

Similarly, at time $t_3$ a value of 2 is stored in tag address location D to indicate the third occurrence of the value 3C, a value of 3 is stored in address location C to indicate the fourth occurrence of the value 3C. When a new value D1 occurs at tag address location B, a new run length tag of 0 is stored in address location B and the tag generation process continues in the same manner until the tag address value reaches address location 0 of the tag frame.

Although the value at tag address location 0 is the fourth occurrence of the value 3C, because the display controller is in the pipeline mode and the display address pointer is on another frame, the data in this frame is no longer accessible. This is why a value of 0 is stored at tag address location 0 in cases for a decrementing address BITBLT transfer display memory.

When the video scan occurs on full block $F_0$, a 0 is read at tag address location 0 forcing it to read the second address which also has the value of 3C. The address pointer is incremented to tag address 1 which shows the value of 3C occurs three more times. The tag address location is then incremented to tag address location 4. The tag value indicates that the value of B2 occurs four more times, the tag address of D1 occurs two more times, and the tag address value of 3C occurs four times.

Non-Pipeline Mode

Figure 10B:
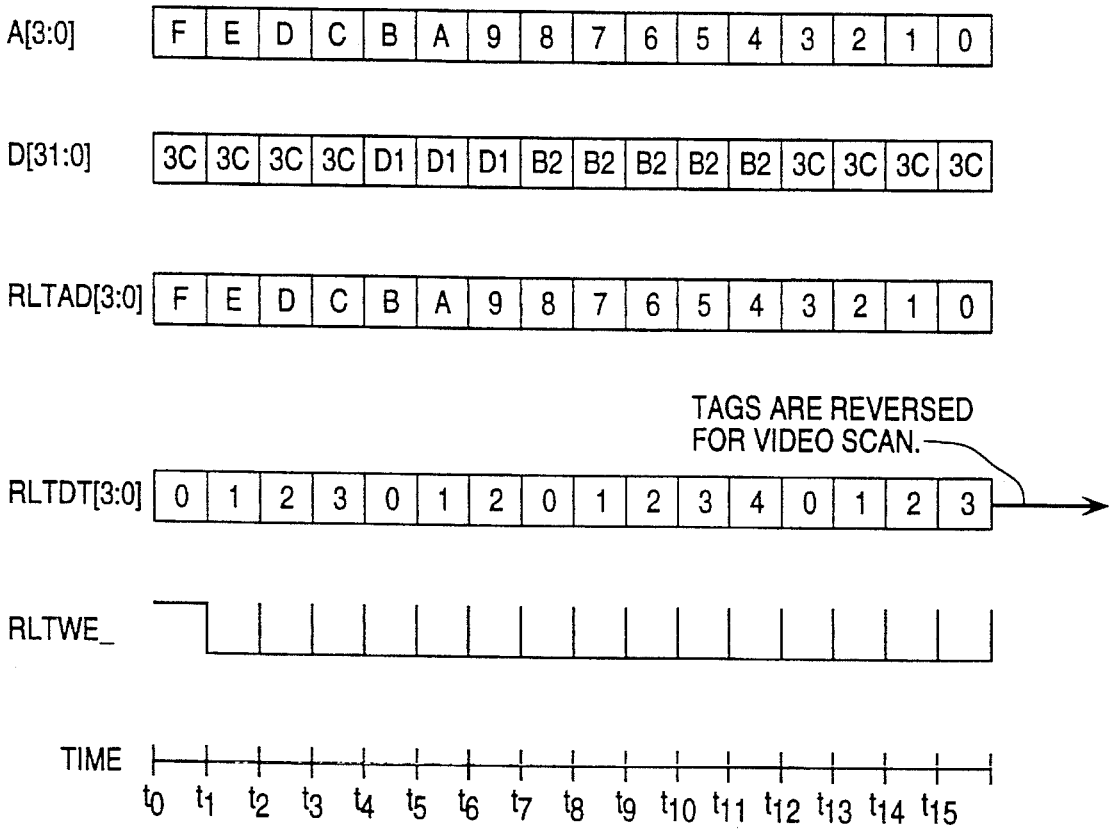
FIG. 10B is a timing diagram corresponding to the BITBLT tag update operation in FIG. 10A in the non-pipeline mode where the video scan is in a decrementing address mode.

FIGS. 10A and 10B show BITBLT tag address data in a non-pipeline mode. Referring to FIG. 10B, in the case of a decrementing address the tag pointer begins the tag frame pointing at tag address location F instead of pointing at tag address 0 as of a decrementing BITBLT transfer in the pipeline mode. In this example, a display memory value of 3C is stored at address location F. Since this is the first time the value 3C is encountered, a value 0 is stored in tag address location F to indicate the first occurrence of the data value. Similarly at tag address location E, another value of 3C occurs in display memory. The tag value is incremented to a value of 1 to indicate that two occurrences of the value 3C have occurred. However, unlike the example of FIGS. 8A and 8B, the tag address pointer is decremented instead of incremented so that instead of writing a tag value of 1 into address location F, the tag value of 1 is stored at tag address location E.

Similarly, a value of 2 is stored in tag address location D to indicate the third occurrence of the value 3C, a value of 3 is stored in address location C to indicate the fourth occurrence of the value 3C. When a new value D1 occurs at tag address location B, a new run length tag value of 0 is stored in address location B. The tag generation process continues in the same manner until the tag address value reaches address location 0 of the tag frame.

The video scan of block $F_0$ occurs with incrementing addresses. When the video scan reads a full block $F_0$, a 3 is read at tag address location 0 which shows the value of 3C occurs three more times. The tag address location is then incremented to tag address location 4. The tag value indicates that the value of B2 occurs four more times, the tag address of D1 occurs two more times, and the tag address value of 3C occurs four times. If the frame contained all of the same values of display data, care must be taken not to write an "F" as a tag into tag location 0. Instead when tag value "E" is reached, the next tag should be "0".

Tag Unaware Operation

A tag unaware operation is a process that after updating certain memory locations, relies on the next sequential memory access to do an automatic tag regeneration. For example, when the CPU writes directly to display memory 510, 512 a single data location within a tag frame is changed. This has the effect of "dirtying" the tag data for the entire frame since a single write has no knowledge of the other 15 data items in the frame. To force the tag data to be recognized as "dirty", a tag data value of F (0 using the next address method) is written in the first address location of the tag frame as shown in FIG. 7. On the next display refresh scan this isolation tag frame is recognized as dirty and the tag regeneration sequence is activated.

The display refresh may be interrupted in the middle of reading a tag frame by a tag unaware process which writes to that tag frame. The tag circuitry detects that the current tag frame has been written to by comparing the 16 MSBs of the tag unaware process' write address to that of the current tag frame. When the display refresh resumes following the interrupt it ignores the tag data in that tag frame. On the subsequent display refresh scan the tag circuitry will discover that the tag frame is dirty because of the F which the tag unaware process wrote to the tag data at tag address 0. A tag regeneration process is invoked and correct tag data is saved.

Prior Art Display Controller

Figure 11:
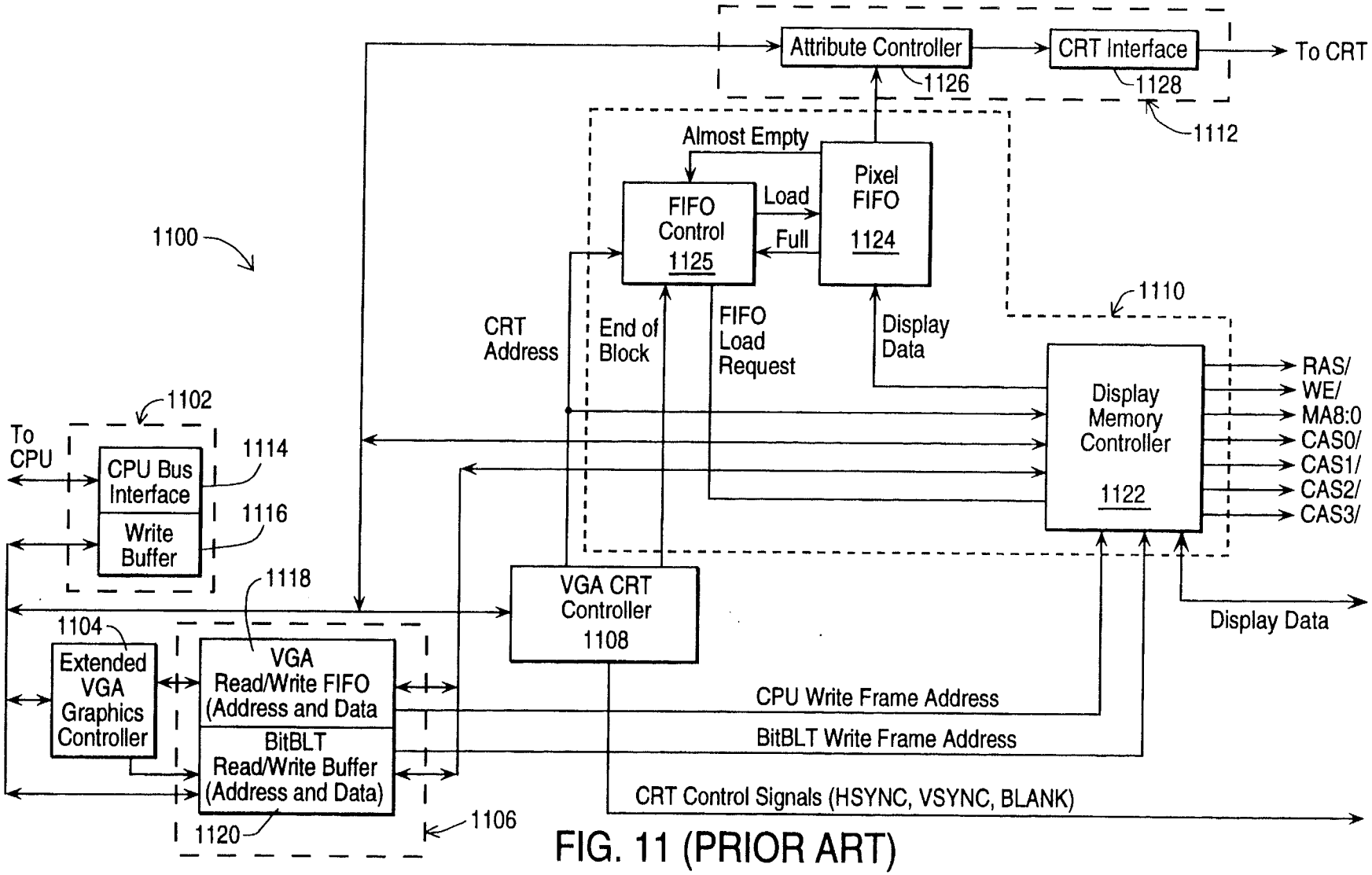
FIG. 11 (PRIOR ART)
FIG. 11 is a block diagram of a prior art VGA accelerator.

FIG. 11 is a block diagram of a prior art VGA accelerator display controller. The display controller shown in FIG. 11 comprises a PC/AT ISA bus interface and write buffer 1102, a graphics controller block 1104, a BITBLT and FIFO block 1106, a CRT controller block 1108, a display memory sequencer block 1110 and an attribute controller and CRT interface 1112. PC/AT ISA bus interface and write buffer 1102 further comprises a CPU bus interface 1114 and a write buffer 1116. BITBLT and FIFO block 1106 further comprises a VGA read/write FIFO 1118 and a BITBLT read/write buffer 1120. Display memory sequencer 1110 further comprises a display memory controller 1122, a pixel FIFO 1124 and a FIFO control block 1125. Attribute controller and CRT interface 1112 comprises an attribute controller block 1126 and a CRT interface block 1128.

Data from the CPU is input into PC/AT ISA bus interface and write buffer block 1102. CPU bus interface 1114 converts external CPU bus signals into an internal format for memory and control register reads and writes. In order to maintain the bus speed data is transferred from CPU bus interface 1114 into write buffer 1116. Write buffer 1116 acts as a temporary storage latch which buffers the internal state timing from the external asynchronous bus timing. Write buffer circuit block 1116 permits the CPU bus to be relieved immediately during write cycles. It is analogous to a FIFO having a depth of 1.

Data is transferred from write buffer 1116 into either CRT controller block 1108, graphics controller block 1104, or FIFO and BITBLT circuit 1106. Extended VGA graphics controller 1104 performs logic operations/transformations on the data as it moves between the CPU and display memory. In the accelerated VGA controller being described, many extensions have been added to the standard set of VGA operations. These include control for hardware BITBLT operations, line drawing operations, pattern fill operations, and other extensions to enable higher resolutions and color depth beyond the VGA standard.

Data may be transferred between graphics controller 1104 to either VGA read/write FIFO 1118 or BITBLT read/write buffer 1120. VGA read/write FIFO 1118 typically stores CPU write operations while display memory controller 1122 is busy. Read/write FIFO 1118 may also buffer read operations (look-ahead) if bandwidth is available. Typically this read/write FIFO is 2–8 operations deep.

Block transfer BITBLT operations possibly consume more bandwidth than any other graphics operation. Most VGA accelerators add hardware to perform this time consuming operation. This hardware generally consists of a buffer which is filled quickly from the source and then block written to the destination. Typically the source and destination data are from display memory but may also be from the CPU.

CPU data may also be transferred directly to the control registers in CRT controller 1108. The CRT controller 1108 performs timing operations to synchronize operations for the CRT with the display memory data stream. It generates the SYNC and BLANK signals, counts the pixels horizontally and the lines vertically. It also generates the current address for data to be sent to the screen.

Data is sent from BITBLT and FIFO block 1106 to display memory controller 1122. The display memory controller generates memory timing cycles for memory read/write request. In addition, it performs address translation mapping if necessary. Requests may come from pixel FIFO control 1125, read/write FIFO 1118, or BITBLT buffer 1120. The pixel FIFO 1124 receives data bursts from the display memory through display memory controller 1122 which are to be output to the CRT. FIFO control block 1125 detects when pixel FIFO 1124 is getting empty and requests the display memory controller to pass more display data to the Pixel FIFO.

Attribute controller 1126 maps the numbers to assigned colors. The CRT interface is the output stage to the CRT monitor. In the VGA standard, this interface communicates to an external D/A converter. The CRT display uses an analog rather than a digital interface.

Display Controller Incorporating Run Length Tagging

Figure 12:
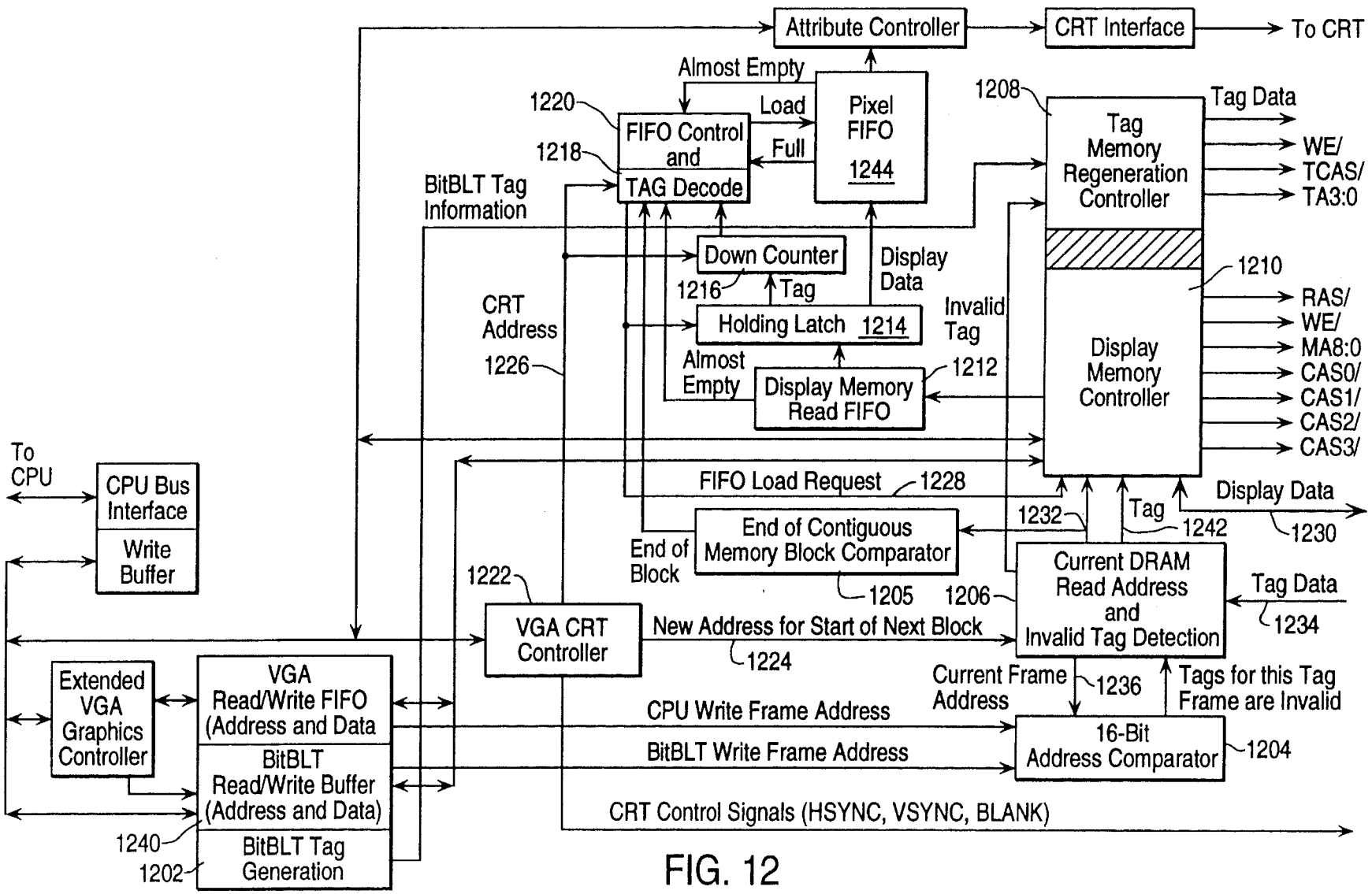
FIG. 12 is a block diagram of a display controller having tag generation logic according to the present invention where the tags are generated using the down count method.
Figure 13:
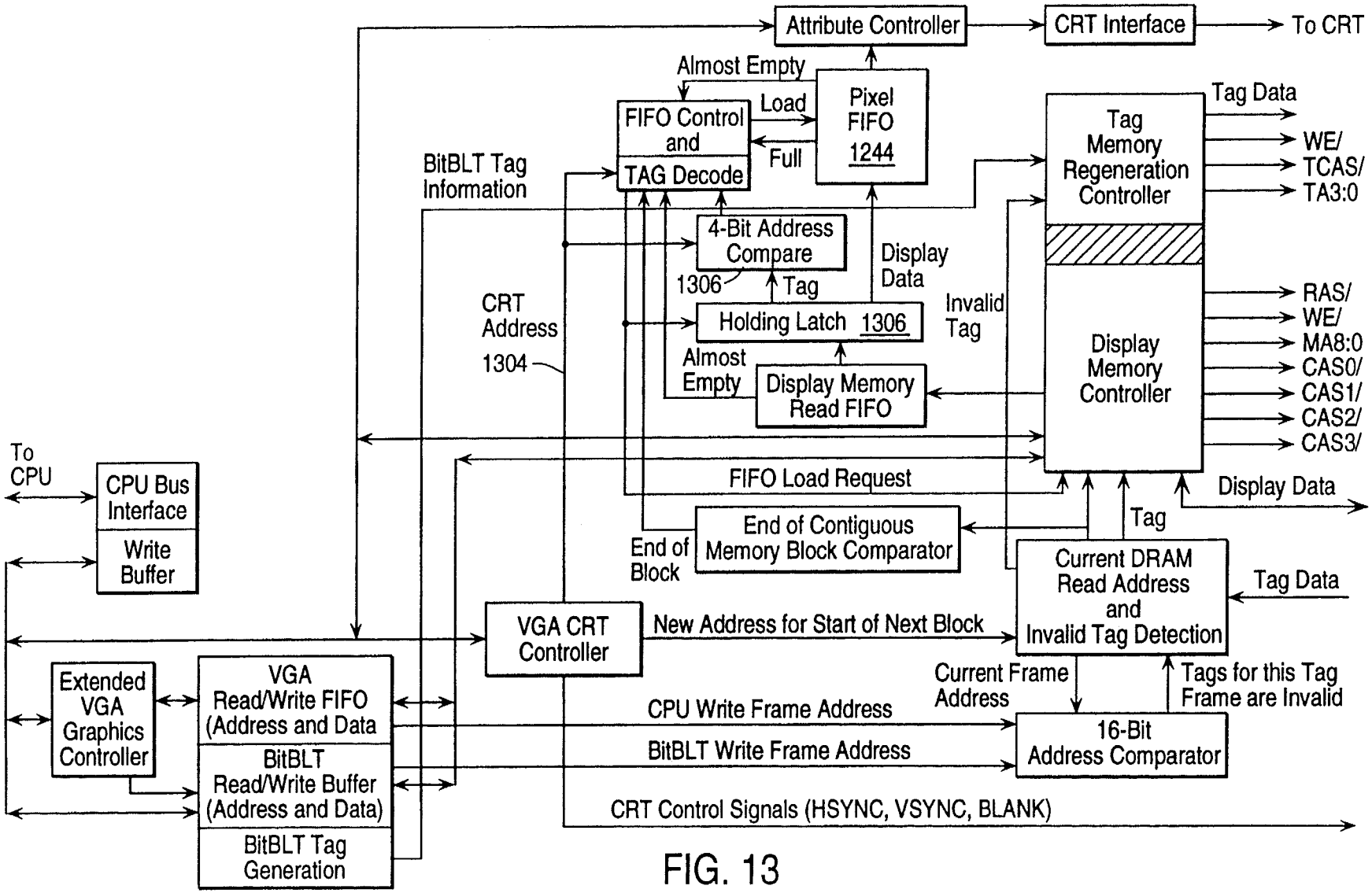
FIG. 13 is a block diagram of a display controller having tag generation logic according to the present invention where the tags are generated according to the next address method.

FIGS. 12 and 13 are block diagrams of display controllers having similar operation and configuration to the controller of FIG. 11, but having additional circuitry for support of tag operation. As noted above, the entire display controller is typically integrated on a single chip.

FIG. 12 shows such additional circuitry to support the tag function using the down count method. This circuitry includes a BITBLT tag generation circuit block 1202, a 16-bit address comparator 1204, an end of contiguous memory block comparator block 1205, a current DRAM read address and invalid tag detection circuit block 1206, a tag memory regeneration controller 1208, which is part of display memory controller 1210, display memory read FIFO 1212, a holding latch 1214, a down counter 1216, and tag decode logic block 1218, which is part of the FIFO control and tag decode circuit block 1220.

The display controller shown in FIG. 12 operates as follows. When reading back compressed data at the beginning of a new screen, CRT controller 1222 outputs a new address on line 1224. This address is the new address for the start of the next block of data to be transferred. This address is input into the current DRAM read address and invalid tag detection block 1206 and becomes the current DRAM read address. The new address for the start of the block also is input into FIFO control block 1220 on bus 1226. FIFO control block 1220 sends a load request on line 1228 to display memory controller 1210.

Display memory controller 1210 reads the current address on line 1232 from current DRAM read address block 1206. The DRAM address is used for reading display data on line 1230. The DRAM data is sent to display memory read FIFO 1212 via display memory controller 1210.

At the same time display data is read from bus 1230, tag data on line 1234 is read into current DRAM read address and invalid tag detection block 1206. Tag data block 1206 tests to see whether the tag data is valid or invalid. If the tag data is valid, then tag data is passed through the display memory controller 1240 into display memory read FIFO 1212. As long as display memory read FIFO 1212 is still requesting to be loaded, then the current DRAM value gets updated. (In the down count method of operation the current DRAM value gets updated by adding the down count (the tag value) plus 1 to the current DRAM read address. In the next address method, the DRAM value is updated by substituting the four least significant bits of the current DRAM address with the tag data value just read in.)

Display memory read FIFO 1212 continues reading in new data until (1) the FIFO is full, or (2) the end of the contiguous memory block is reached. For the present implementation using DRAMs, it is advantageous to burst data using page mode cycles into the FIFO until it is full. If the FIFO is full, FIFO controller 1220 sends a signal on bus 1228 to tell display memory controller 1210 to stop loading display memory data. If the end of the contiguous memory block is reached, a signal from end of contiguous memory block comparator 1205 is sent to FIFO control and tag decode block 1220. End of contiguous memory block 1205 indicates that the display controller has reached the end of the scan line. Further loading of the FIFO would only waste cycles which could be used by the CPU for processing.

During a memory load while in the middle of a valid tag frame, display memory controller 1240 may be interrupted. There are two sources of external interrupt; the first being an interrupt by the CPU, the second being an interrupt due to a BITBLT transfer. In order to determine whether a possible corruption of tag data has occurred in the current read address, the current read address is compared to the current write address. The comparison occurs in the 16-bit address comparator 1204. The current read frame address is input from current DRAM read address and invalid tag detection block 1206 into the 16-bit address comparator 1204 and is compared to either the CPU write frame address or the BITBLT write frame address. Only one of these two write frame addresses will be valid at a time, and the valid write frame address is compared to the current read frame address.

The compare only occurs when an interrupt occurs during the middle of reading a tag frame. In the present embodiment, the display address is 20 bits. The 16-bit comparator 1204 compares everything except the four least significant bits of the address. Since the four least significant bits indicate only the address within the frame, matching of the 16 most significant bits indicates a frame match. If a frame match occurs, then the current DRAM read address and invalid tag detection block 1206 ignores all of the tag data for the rest of the frame and reads every location for the rest of the frame. If no frame match occurs the system continues processing.

During a tag aware process such as a BITBLT operation, BITBLT tag generation block 1202 passes display data from BITBLT read/write buffer 1240 to display memory controller 1210 and simultaneously from BITBLT tag generation block 1202 to the tag memory regeneration controller 1208.

A dirty tag frame is detected during display data readback in the current DRAM read address and invalid tag detection circuit block 1206. Block 1206 reads tag address 0 of each frame and sees if a dirty tag is present. If a dirty tag is present it (1) continues to read the rest of the frame sequence ignoring tag data and (2) sends an invalid flag on line 1242 to the tag memory regeneration controller 1208. When tag memory regeneration controller 1208 reads a dirty tag, it performs a regeneration operation.

When a frame is invalid and the down count method is being utilized, a "0" tag is passed on line 1242 through display memory controller 1210 into display memory read FIFO 1212. The dirty tag indicates that a read must be made at each location. When a frame is invalid and the next address method is being utilized, data is continued to be passed to FIFO 1212 and its 4 LSB display address is passed as the tag data into FIFO 1212.

No matter if the tags are valid or invalid, only clean tag data is passed from display memory controller 1210 into display memory read FIFO 1212. When display memory read FIFO 1212 starts filling up, data is input into holding latch 1214. When holding latch 1214 has valid data in it, FIFO control circuit block 1220 clocks data into pixel FIFO 1244 and into Down Counter 1216. Load signal 1246 indicates whether data is being loaded into pixel FIFO 1244. When data is being loaded into pixel FIFO 1244, down counter 1216 decrements its value by 1. Each time new data is latched into Pixel FIFO 1244, the down counter 1216 is decremented. When down counter 1216 reaches a value of (−1), a new data value is latched into holding latch 1214 and a new tag value is latched into down counter 1216.

FIG. 13 is a block diagram of the display controller for tag generation using the next address method. Operation of the display controller shown on FIG. 13 is similar to the display controller shown in FIG. 12 and at this time appears to be the preferred embodiment. The next address method simplifies the circuit implementation since no addition is necessary to compute the next address of data to be fetched. Using the down count method, the next address to be fetched is calculated by adding the current display memory address to the value stored in the tag RAM plus 1. Using the next address method this calculation and the circuitry necessary to support such a calculation, is not necessary.

The circuit block diagram shown in FIG. 13 is similar to that of FIG. 12 with the exception of a 4-Bit address compare circuit block 1302. The down counter 1216 of FIG. 12 is replaced with a 4-bit address compare 1302. In the down count method, the count of repetitive data is stored in down counter 1216 and data is output until the down counter reaches a value of (−1). In the next address method, the tag address stored in 4-bit address compare 1302 is compared to the 4 LSBs of the CRT address on bus 1304. Data is output from holding latch 1306 into pixel FIFO 1308 until a match between the tag address and current CRT address occurs. When a match occurs, a new data value is input into holding latch 1306 and address comparison process continues.

Embodiments With Tags in Display Memory

The first set of embodiments described above use a physically and logically separate tag RAM (i.e., a different memory array) to store the run length tags (the number of repetitions in the first case, and the address of next different data item in the second case). It is sometimes possible to store tag information in the same memory array as the display data items. A second set of embodiments using this approach are described below, one with the tags in a contiguous block of off-screen memory, and the other with the tags interleaved with the display data.

These embodiments require that the single memory array be large enough to contain the display data and the tags. To make this possible for a wide range of resolutions and color depths, these embodiments are based on a 1-bit tag per 32-bit DWord, (i.e., one tag DWord for each 32 DWords of display data). For example a 640×480 display with 8-bit color (256 colors) requires 307,200 bytes of display memory (76,800 DWords) and 9,600 bytes of tag memory. This easily fits within a 1-MB memory (1,048,576 bytes). Similarly, other resolution/depth combinations such as 800×600/8, 1024×768/8, 1152×864/8, 640×480/16, 800×600/16, and 640×480/24 can fit. As for the first set of embodiments described above, the memory system is assumed to be 32 bits wide.

Contiguous Block of Tag RAM in Display Memory

Figure 14:
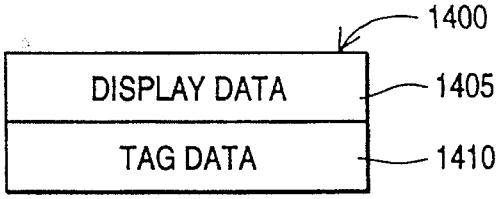
FIG. 14 is a schematic representation of the organization of the display and tag memory according to a first one of the second set of embodiments.

FIG. 14 shows the organization of the display memory, denoted 1400, which for this embodiment has a first contiguous block 1405 containing display data items (pixel values) for the screen and a second contiguous block 1410 containing tag data corresponding to the display data items. The tag for every DWord is 1 bit and indicates if that DWord is the same as the previous DWord. Thus, 1 DWord of tag bits corresponds to 32 DWords of display memory.

Figure 15:
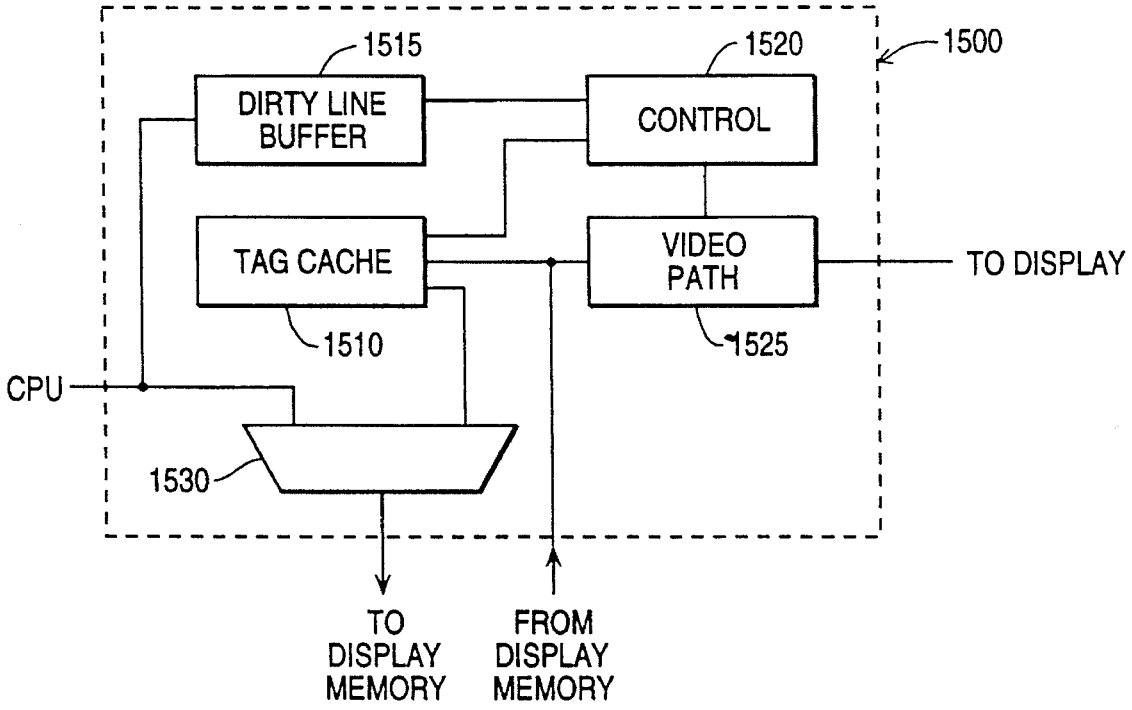
FIG. 15 is a block diagram of a display controller according to the first one of the second set of embodiments.

FIG. 15 is a block diagram of a display controller 1500 for utilizing the tag information from the display memory. The controller includes certain on-chip storage elements including a tag cache 1510 and a dirty line buffer 1515. These cooperate with the normal display controller subsystems, shown as a control block 1520, a video path block 1525, and a display memory output multiplexer 1530. In case of a tag DWord corresponding to display data DWords Y through Y+31, the mapping of the tag bits could be as follows. Bit 31 would be unused, and bits 30, 29, ... 1, and 0 would correspond to display data DWords (Y+1), (Y+2), . . . (Y+30), and (Y+31), respectively.

On start up (or reinitialization), the tag data is not read. Rather, the entire display data is read, and whenever a DWord is the same as the previous DWord, the tag for that DWord in the tag cache is set; else the tag is cleared. The tag data for a full scan line is generated as the data items are sent to the screen. At the end of the scan line (during the retrace interval), the tag data is written to off-screen memory block 1410.

Once the tag data is generated, it is used to reduce display memory accesses while refreshing the screen. During the horizontal retrace interval, the tag data for the next scan line is read into display controller 1500 and stored in tag cache 1510. After this, for every bit in the tag cache that indicates a new DWord, the corresponding DWord is read from memory and sent to the display. For every bit of the tag that indicates a repeat of the previous DWord, the previous DWord is sent again to the display without having to be read from memory.

Dirty line buffer contains one bit for every scan line of the display. For example, if resolutions having 864 scan lines are to be supported, the dirty line buffer would have to be 108 bytes long. Each bit indicates if the corresponding scan line in the display memory has been modified since the last time tag data was generated for that scan line. Normally, once the tag data for a scan line is generated and written to memory, its corresponding bit in the dirty line buffer is cleared.

When the CPU writes to the display memory, the dirty line bit for the scan line that was written to is set. The next time, the display controller is ready to display that scan line, it first checks the dirty line bit for that line. If the bit is not set, the display controller then fetches the tag data for that line into the tag cache. If the dirty line bit is set, then the tag data is not read. Instead, the display data is read, the tags are generated and written into the tag cache, and then the generated tag data is written to memory.

In the worst case, the tag data for the previous scan line has to be written to memory and the tag data for the next scan line has to be fetched from memory during one retrace interval. The retrace interval must be long enough to allow this. In the worst case of 480 DWords/scan line (a tag data length of 15 DWords) it is necessary to be able to do 15 pagemode write and 15 page mode read accesses to the display memory during the retrace interval. This can easily be done in a 4-microsecond horizontal retrace interval.

Interleaved Tag RAM and Display Data

Figures 16, 17:
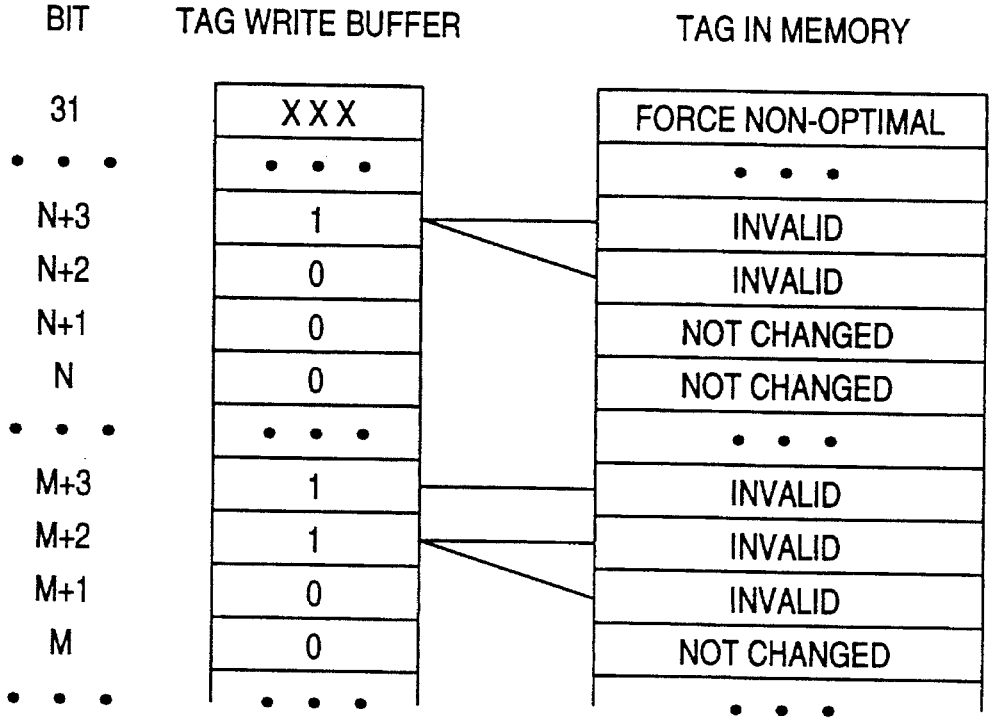
FIG. 16 is a schematic representation of the organization of the display and tag memory according to a second one of the second set of embodiments.
FIG. 17 shows how the tags in memory are updated from the tag write buffer.

FIG. 16 shows the organization of a single memory array 1600 where the tag data and the display data are interleaved in the memory. In the case of a 32-bit wide display memory, one DWord of tag data is inserted for every 32 DWords of display data.

As the display data is fetched, the tag data is fetched first and then depending on the tag data, some of the display data is not fetched. An advantage with this embodiment is that only 1 DWord of tag data has to be stored on the controller chip, so a large tag cache is not needed. Also, since the tag and display data are interleaved in memory, they can both be fetched in the same page mode sequence.

On startup (or reinitialization), the tag data is ignored, the complete display data is read from display memory, a new tag DWord is generated for each block of display data and written to the display memory.

On CPU updates to the display memory two type of updates, referred to as regular updates and block updates, can be supported. In the case of a regular update, after every CPU access to the display memory, the tag DWord for that memory location is read, 1 or 2 bits are modified and written back to memory. This will consume higher bandwidth than if the tag data was not present. However the saving in total memory bandwidth by use of the tag information more than offsets the additional memory bandwidth used to update the tags. Also with a tag write buffer, the CPU latency to a write is minimized.

When the CPU does block updates, then the tag DWord is written only after a number of display memory write cycles. In effect by having a 1-deep tag write buffer on the controller chip and implementing bit write merges in this buffer, the memory bandwidth can be optimized as far as updating the tag data.

One way to implement this is to clear the tag write buffer initially. Then, after every CPU write to memory the corresponding bit in the tag write buffer is set (marked changed). As long as the CPU continues to write to display memory that corresponds to the same tag DWord, additional bits in the tag write buffer are set. Whenever the CPU writes to a display memory location that belongs to a different tag DWord, the tag write buffer is flushed to memory, then cleared, and a new bit corresponding to the new display memory location is set in the internal tag write buffer.

Note that flushing the tag write buffer to memory means that the tag bits in memory corresponding to the bits set in the write buffer have to be marked as changed, the following bit also has to be marked as changed, and the other bits are left unchanged. This is shown in FIG. 17.

In the case where the CPU writes only a single DWord, then the internal tag write buffer will indicate this change but the change will not be reflected in the tags in the display memory until a different tag DWord is affected (when the previous tag data will be flushed). To overcome this problem, if there is valid data in the internal tag write buffer for more than some amount of time (say, 1 frame), it should be flushed to the memory automatically (flushing based on aging).

The block update mechanism can be implemented completely in hardware or under control of software that can be enabled or disabled. It should be noted that the block update method can be a superset of the single update method. In case of a tag DWord corresponding to display data DWords Y through Y+31, the mapping of the tag bits could be as in the first method (shown in FIG. 16), except that bit 31 of the tag DWord is now used to indicate if the tag word is optimal or non-optimal. A non-optimal tag DWord indicates that the tag is valid but that some bits marked as changed may not have been changed, and therefore that the tag should be regenerated. On being regenerated, bit 31 should be set to the optimal state.

One advantage of the second method (interleaved tags) over the first method (tags in block of off-screen memory) is that if a single memory location is updated by the CPU, the first method marks the entire scan line containing that memory location as completely non-repetitive. The second method only marks two DWords as non-repetitive. The first set of embodiments marks 16 DWords as completely non-repetitive.

The second method has the inconvenience, however, that the process of updating the display data has to leave a one-DWord "hole" for the tags after every 32 display data DWords. Although this can be done, it adds a lot of overhead to the software. This can be avoided by taking the CPU address and modifying it in hardware to automatically create these holes, and using the modified address as the physical memory address.

Figure 18:
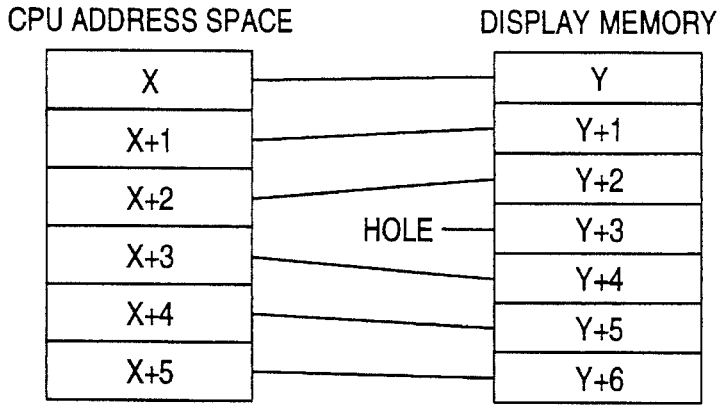
FIG. 18 shows the address mapping to accommodate interleaved tags for the second one of the second set of embodiments.

FIG. 18 shows schematically such an address mapping. The address translation has to take the RAW address (from the CPU or CRT controller), designated LA, and generate the physical memory address, designated PA as set forth in the following equation:

$$PA=LA+(int(LA/32))+1=LA+(LA>>5 \text{ bits})+1$$

The "+1" term in the equation is not necessary, but is preferred since it puts the tag DWord for a 32-DWord block before the 32-DWord block in the display memory. This allows the display controller to read the tag before the display data while still only increasing the memory address.

The tag address, designated TA, for any raw address LA can be computed as:

$$TA=(LA \ \& \ 0\times FFFFE0)+(LA>>5 \text{ bits})$$

The tag address is used by the tag invalidating hardware to mark the tag as being invalid whenever the CPU writes the display memory. The CRT controller needs to fetch a new tag Dword every 32 display dwords. This is easily detected by the lower 5 bits of the raw CRT address being zero.

This translation can be done on all memory addresses (those generated by the CPU or the display controller). This way, the CPU and the display controller will generate addresses assuming that there are no holes in the memory. In fact by doing this translation at the last stage in the memory address path, the second method can even be used for VGA compatible modes where there is a lot of address scrambling between the different display modes.

Figure 19A:
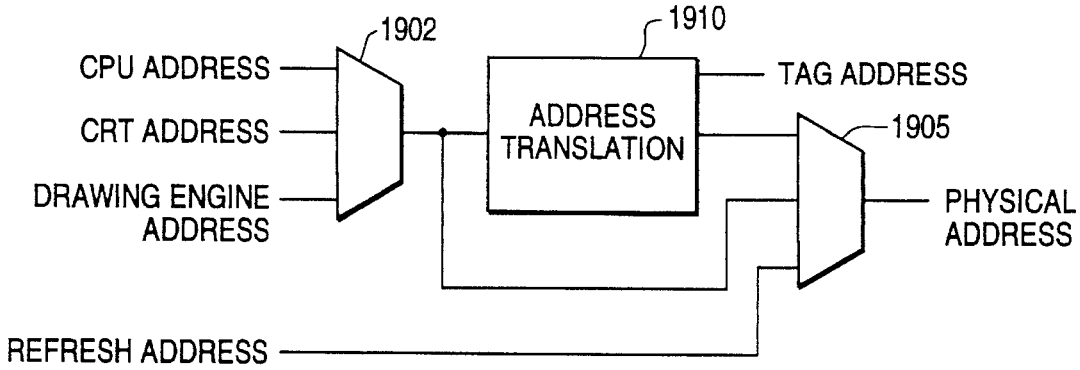
FIGS. 19A and 19B are block diagrams of address translation circuitry for the second one of the second set of embodiments.

FIG. 19A is a block diagram showing the possible mapping of addresses to generate "holes" and tag addresses. A first multiplexer 1902 selects an incoming address, generated without "holes" by one of the possible sources of display addresses (CPU, display controller, graphics accelerator), and communicates it to an output multiplexer 1905, both directly and also through an address translation unit 1910. Address translation unit 1910 also provides tag addresses. The direct path (bypassing the address translation unit) is used when the tag mechanism is disabled. A third input to the output multiplexer is for DRAM refreshes.

Figure 19B:
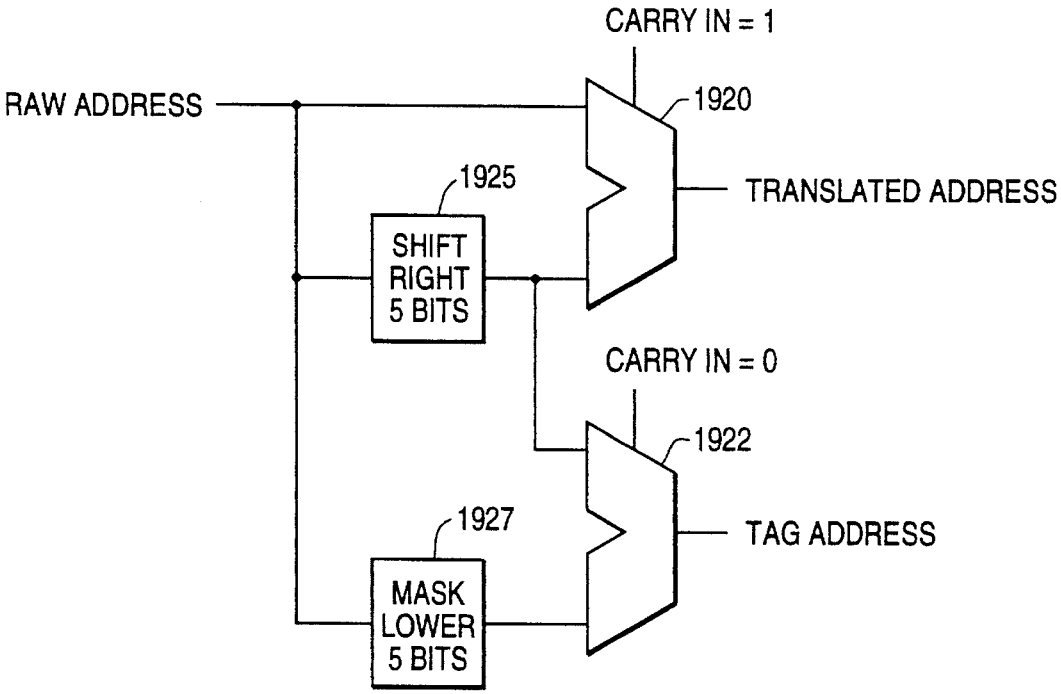

FIG. 19B is an expanded block diagram of address translation unit 1910, the purpose of which is to implement the equations for PA and TA set forth above. To that end, the address translation unit includes a pair of adders 1920 and 1922. Adder 1920 receives the raw address at a first input and a version of the raw address that has been right-shifted 5 bits (block 1925) at a second input, and adds them with a carry in to provide the translated address. Adder 1922 receives the right-shifted version of the raw address at a first input and a version of the raw address with the five LSBs masked off (block 1927) at a second input to provide the tag address.

Both these embodiments can be used in standard VGA and extended VGA modes. In the case of standard VGA modes, if all planes in the display memory are not being used, then the tag generation can be optimized to look only at the planes being used (e.g. in text mode only bytes 0 and 1 of every DWord need to be considered when generating the tag data). However, if this is done in standard VGA modes, whenever the plane mask register is changed, all the tag data will have to be regenerated.

In the case of a hardware accelerator, it can be treated as the CPU with the tag being generated as the data is written to memory. Additionally, when the hardware accelerator needs to read display memory, the tag concept can be used in the process to reduce read memory bandwidth.

Conclusion

In conclusion, it can be seen that the present invention provides an elegant way to allow the display to keep up with the CPU. By reducing the number of display memory accesses required for the critical refresh process, the invention makes scarce bandwidth available for updating the display memory, and thus provides the user the benefit of a more responsive machine.

As will be understood by those familiar with the art, the present invention may be embodied in other specific forms without departing from the spirit or essential characteristic thereof. In the first set of embodiments, a 4-bit tag is associated with a 16-DWord frame. This example was chosen because it represents memory configurations readily available (256K×4 DRAM) today. The methods described will also be applicable to different tag memory widths, main memory widths, and tag frame lengths. Also, other variations are possible. For example, the tag RAM memory could be placed within the display controller in order to increase the number of address lines without increasing the pin limitations. Also, instead of looking for the repetition of a single display data value, the display controller could compare a series or pattern of display data values. Furthermore, while the first-described embodiment uses a down counter, any counting mechanism can be used.

Accordingly, the disclosure of the preferred embodiments and other specific embodiments is intended to be illustrative, but not limiting, the scope of the invention which is set forth in the following claims.

What is claimed is:

1. Apparatus for providing to a display device, a display field made up of a plurality of data items without the necessity of accessing a display memory for all of said items, comprising:

a display memory for storing said field of data items in uncompressed form;

means for maintaining a record in addition to said field, of at least some data value repetitions in said field;

means for accessing said display memory to obtain a subset of data items that does not include at least some of the data value repetitions in said field;

means for producing said field from the subset and the record of data value repetitions; and means for outputting the produced field to said display devices;

whereby said access means and said producing means operate together to provide said display field directly to said display device without requiring additional memory for storing said display field so as to reduce the number of accesses to the display memory.

2. The apparatus of claim 1 wherein said maintaining means maintains a record in addition to said field, of at least some sequential repetitions of data values in said field.

3. The apparatus of claim 1 further including means for computing a revision to said record while the storage of counterpart data items is changed.

4. The apparatus of claim 1 further including means for causing said record to be changed at the same time that a subset of data items are being read from said display memory.

5. The apparatus of claim 1 wherein said display memory and said record maintenance means are in separate memory arrays.

6. The apparatus of claim 1 wherein said display memory and said record maintenance means are in the same memory array.

7. The apparatus of claim 1 wherein:

said means for maintaining includes means for indicating whether said record of data repetitions is currently valid or not; and said access means operates in response to an indication that said record of data repetitions is currently not valid to invoke means for computing said record of data repetitions.

8. The apparatus of claim 1 wherein said maintaining means further comprises:

means, responsive to a write to any of a predetermined sequence of data items, for generating an indication that a portion of said record of data repetitions is no longer valid.

9. The apparatus of claim 1 wherein said record of data repetitions includes a value representative of the number of data repetitions.

10. The apparatus of claim 1 wherein said producing means comprises:

a pixel first-in-first-out register array (FIFO);

a holding latch for receiving data from the memory; and control means;

said FIFO being coupled to said control means and said holding latch, said FIFO receiving data from said holding latch.

11. The apparatus of claim 10, further comprising a counter wherein data is output from said holding latch to said pixel FIFO until said counter reaches a predetermined value.

12. The apparatus of claim 1 wherein said record of data repetitions includes a value representative of the address of a subsequent data item.

13. The apparatus of claim 12, further comprising an address comparator for comparing said address value to a current address value.

14. In a method of refreshing a display device, a combination of steps comprising;

storing a field of a plurality of data items for said refreshing in uncompressed form in a display memory;

maintaining a record in addition to said field, of at least some data value repetitions in said field;

accessing said display memory to obtain a subset of display items that does not include at least some of the data value repetitions in said field;

producing said field from the subset and said record; and outputting the produced field to said display device;

whereby it is unnecessary to access said display memory for all of said data items to provide said display field directly to said display device without requiring additional memory for storing said display field to reduce the number of accesses to the display memory.

15. The method of claim 14 wherein said step of maintaining includes maintaining a record in addition to said field of at least some sequential repetitions of data values in said field.

16. The method of claim 14 further including the steps of revising said data items that are stored; and computing a revision to said record while said stored data items are revised.

17. The method of claim 14 wherein said step of storing includes partitioning said field into discrete portions, and said step of maintaining a record of data value repetitions includes determining if a revision includes both a partial portion and a following entire portion, and, if a revision includes such a partial portion and a following entire portion, updating the record of data value repetitions for said entire portion at the same time such portion itself is revised.

18. The method of claim 17 wherein said step of maintaining includes determining if the revision includes both a partial portion and a plurality of following entire portions, and, if the revision includes such a partial portion and a plurality of following entire portions, updating the record of data value repetitions for all of said entire portions at the same time such portions themselves are revised.

19. The method of claim 14 wherein said step of storing includes partitioning said field into discrete portions, and said step of maintaining a record of data value repetitions includes indicating at each of said portions that there is a change in the data items of said portion.

20. The method of claim 19 wherein said maintaining step further comprises the step of generating a record indication that said portion of said record of data repetitions is no longer valid in the event of at least some changes in data items of said portion.

21. The method of claim 14 wherein said maintaining step comprises the step of storing information regarding the data repetitions in an additional number of memory locations.

22. The method of claim 14 wherein:

said maintaining step includes the step of indicating whether the record of data repetitions is currently valid or not; and computing an up-dated record in response to an indication that the record of data repetitions is currently not valid.

23. The method of claim 14 wherein the record of data repetitions includes a value representative of the number of sequential data repetitions.

24. The method of claim 14 wherein the record of data repetitions includes a value representative of the address of a subsequent different data item.

* * * * *